US010192470B2

(12) United States Patent
Ushijima

(10) Patent No.: US 10,192,470 B2
(45) Date of Patent: Jan. 29, 2019

(54) APPARATUS AND METHOD FOR OUTPUTTING IMAGE INFORMATION, AND NON-TRANSITORY COMPUTER-READABLE STORAGE MEDIUM FOR STORING PROGRAM FOR OUTPUTTING IMAGE INFORMATION

(71) Applicant: FUJITSU LIMITED, Kawasaki-shi, Kanagawa (JP)

(72) Inventor: Satoru Ushijima, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/728,558

(22) Filed: Oct. 10, 2017

(65) Prior Publication Data

US 2018/0137793 A1 May 17, 2018

(30) Foreign Application Priority Data

Nov. 17, 2016 (JP) ..... 2016-224362

(51) Int. Cl.
*G09G 1/00* (2006.01)
*G09G 3/02* (2006.01)

(52) U.S. Cl.
CPC ..... *G09G 1/002* (2013.01); *G09G 3/025* (2013.01)

(58) Field of Classification Search
CPC ..... G09G 1/002; G09G 3/025; H04N 2201/0468; H04N 2201/04767; G02B 26/10; G02B 26/105
See application file for complete search history.

(56) References Cited

U.S. PATENT DOCUMENTS 5,982,524 A * 11/1999 Fujimoto ..... G02B 26/126 359/208.1
7,079,297 B2 * 7/2006 Sakai ..... G02B 26/105 250/236
8,115,980 B2 * 2/2012 Park ..... G02B 26/105 250/234
9,690,092 B2 * 6/2017 Freedman ..... G01B 11/254
(Continued)

FOREIGN PATENT DOCUMENTS

JP 2016-080962 5/2016

*Primary Examiner* — Tom V Sheng
(74) *Attorney, Agent, or Firm* — Fujitsu Patent Center

(57) ABSTRACT

An apparatus executes an acquisition process for acquiring pixel value information items from a sensor that outputs the pixel value information items obtained at multiple sampling angles by executing a reciprocation scan with a measurement wave in a scan direction; executes a calculation process for calculating, based on the pixel value information items for one reciprocating motion in the reciprocation scan for each of multiple different arrangement orders in which a chronological pixel value information item on a forward path and a reverse-chronological pixel value information item on a backward path are alternately assigned, differences between the chronological pixel value information item and the reverse-chronological pixel value information item which are adjacent to each other in an arrangement direction; and executes a generation process for generating, based on the differences, a correction information item related to the pixel value information items for the one reciprocating motion in the reciprocation scan.

19 Claims, 28 Drawing Sheets

(56) References Cited

U.S. PATENT DOCUMENTS

2006/0192094 A1* 8/2006 Taniguchi ..... G02B 5/00
250/235
2006/0245462 A1* 11/2006 Takeda ..... G02B 26/101
372/93
2007/0047085 A1* 3/2007 Matsumoto ..... H04N 1/0473
359/566
2008/0055388 A1* 3/2008 Klemer ..... B41J 2/471
347/233
2009/0279156 A1* 11/2009 Yen ..... G02B 26/0833
359/199.4
2012/0097833 A1* 4/2012 Lin ..... G02B 13/0005
250/201.1
2016/0377849 A1* 12/2016 Onda ..... G02B 21/008
348/78
2017/0244944 A1* 8/2017 Ohara ..... G02B 26/10

* cited by examiner

FIG. 9

| HORIZONTAL ANGLE | β0 | β1 | β2 | β3 | β4 | β5 | β6 | β7 | β8 | β9 | β10 | β11 | β12 | β13 | β14 | β15 | β16 | β17 | β18 |
|---|---|---|---|---|---|---|---|---|---|---|---|---|---|---|---|---|---|---|---|
| WITHOUT DEVIATION (REGULAR) | | 1 | 16 | 2 | 15 | 3 | 14 | 4 | 13 | 5 | 12 | 6 | 11 | 7 | 10 | 8 | 9 | | |
| WITH DEVIATIONS | | 1 | | 2 | 16 | 3 | 15 | 4 | 14 | 5 | 13 | 6 | 12 | 7 | 11 | 8 | 10 | | 9 |

FIG. 13

| PIXEL TARGETED FOR ASSIGNMENT | PX1 | PX2 | PX3 | PX4 | PX5 | PX6 | PX7 | PX8 | PX9 | PX10 | PX11 | PX12 | PX13 | PX14 | PX15 | PX16 |
|---|---|---|---|---|---|---|---|---|---|---|---|---|---|---|---|---|
| NORMAL ASSIGNMENT METHOD | 1 | 16 | 2 | 15 | 3 | 14 | 4 | 13 | 5 | 12 | 6 | 11 | 7 | 10 | 8 | 9 |
| CORRECTION ASSIGNMENT METHOD (No.1) | 1 | 15 | 2 | 14 | 3 | 13 | 4 | 12 | 5 | 11 | 6 | 10 | 7 | 9 | 8 | * |
| CORRECTION ASSIGNMENT METHOD (No.2) | 1 | * | 2 | 16 | 3 | 15 | 4 | 14 | 5 | 13 | 6 | 12 | 7 | 11 | 8 | 10 |
| CORRECTION ASSIGNMENT METHOD (No.3) | 1 | 14 | 2 | 13 | 3 | 12 | 4 | 11 | 5 | 10 | 6 | 9 | 7 | * | 8 | * |

FIG. 15

| | ASSIGNMENT METHOD (M=-k) | ASSIGNMENT METHOD (M=-k+1) | ··· | ASSIGNMENT METHOD (M=k) |
|---|---|---|---|---|
| FIRST PIXEL ROW | (Sm)=a1 | (Sm)=a2 | ··· | (Sm)=a3 |
| SECOND PIXEL ROW | (Sm)=a4 | (Sm)=a5 | ··· | (Sm)=a6 |
| THIRD PIXEL ROW | (Sm)=a7 | (Sm)=a8 | ··· | (Sm)=a9 |
| | | | | |

APPARATUS AND METHOD FOR OUTPUTTING IMAGE INFORMATION, AND NON-TRANSITORY COMPUTER-READABLE STORAGE MEDIUM FOR STORING PROGRAM FOR OUTPUTTING IMAGE INFORMATION

CROSS-REFERENCE TO RELATED APPLICATION

This application is based upon and claims the benefit of priority of the prior Japanese Patent Application No. 2016-224362, filed on Nov. 17, 2016, the entire contents of which are incorporated herein by reference.

FIELD

The embodiment discussed herein is related to an apparatus, a method for outputting image information, and a non-transitory computer-readable storage medium.

BACKGROUND

In an apparatus for generating an image of an object from pixel value information (information based on amounts of received light or the like) obtained by executing a reciprocation scan on the object with laser light in a main scan direction, a technique for detecting a positional deviation between pixel rows obtained by respective reciprocation scans and extending in a horizontal direction is known.

Examples of the related art include Japanese Laid-open Patent Publication No. 2016-080962.

SUMMARY

According to an aspect of the invention, an apparatus for outputting image information includes: a memory; and a processor coupled to the memory and configured to: execute an acquisition process that includes acquiring pixel value information items from a sensor, the sensor being configured to execute a reciprocation scan with a measurement wave in a scan direction and output the pixel value information items obtained at multiple sampling angles during the reciprocation scan; execute a calculation process that includes calculating, based on the pixel value information items for one reciprocating motion in the reciprocation scan for each of multiple different arrangement orders in which a chronological pixel value information item on a forward path and a reverse-chronological pixel value information item on a backward path are assumed to be alternately assigned, differences between the chronological pixel value information item and the reverse-chronological pixel value information item which are adjacent to each other in an arrangement direction; and execute a generation process that includes generating, based on the differences, a correction information item related to the pixel value information items for the one reciprocating motion in the reciprocation scan.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 9 is a table diagram illustrating an example of a state in which deviations in adjacency relationships between sampling horizontal angles exist;

FIG. 13 is a diagram describing correction assignment methods;

FIG. 15 is a table diagram illustrating results of calculating evaluation values;

DESCRIPTION OF EMBODIMENT

The aforementioned conventional technique is to detect a positional deviation between pixel rows. Thus, if there is a deviation in adjacency relationship between pixel value information items within a pixel row serving as a standard, a similar deviation in an adjacency relationship between pixel value information items within another pixel row may not be corrected.

A "deviation in an adjacency relationship between pixel value information items" within a pixel row occurs due to a deviation of an actual sampling angle from a regular sampling angle upon the acquisition of pixel value information items in the assignment of pixel value information items for one reciprocation scan to pixels of one pixel row.

It is preferable that a pixel value information item assigned to a pixel C located between two pixels A and B be information on a position PXc between positions PXa and PXb located on an object and related to pixel value information items assigned to the two pixels A and B. On the other hand, a state in which the pixel value information item assigned to the pixel C is information on a position PXd that is not located between the positions PXa and PXb indicates a "deviation in an adjacency relationship between pixel value information items" within a pixel row.

According to an aspect, the present disclosure aims to generate pixel rows in which a deviation in an adjacency relationship between pixel value information items does not exist.

Hereinafter, an embodiment is described in detail with reference to the accompanying drawings.

Before a description of an image information output apparatus, a distance measuring apparatus 10 (as an example of a sensor and a distance image sensor) that collaborates with the image information output apparatus is described below.

Figure 1:
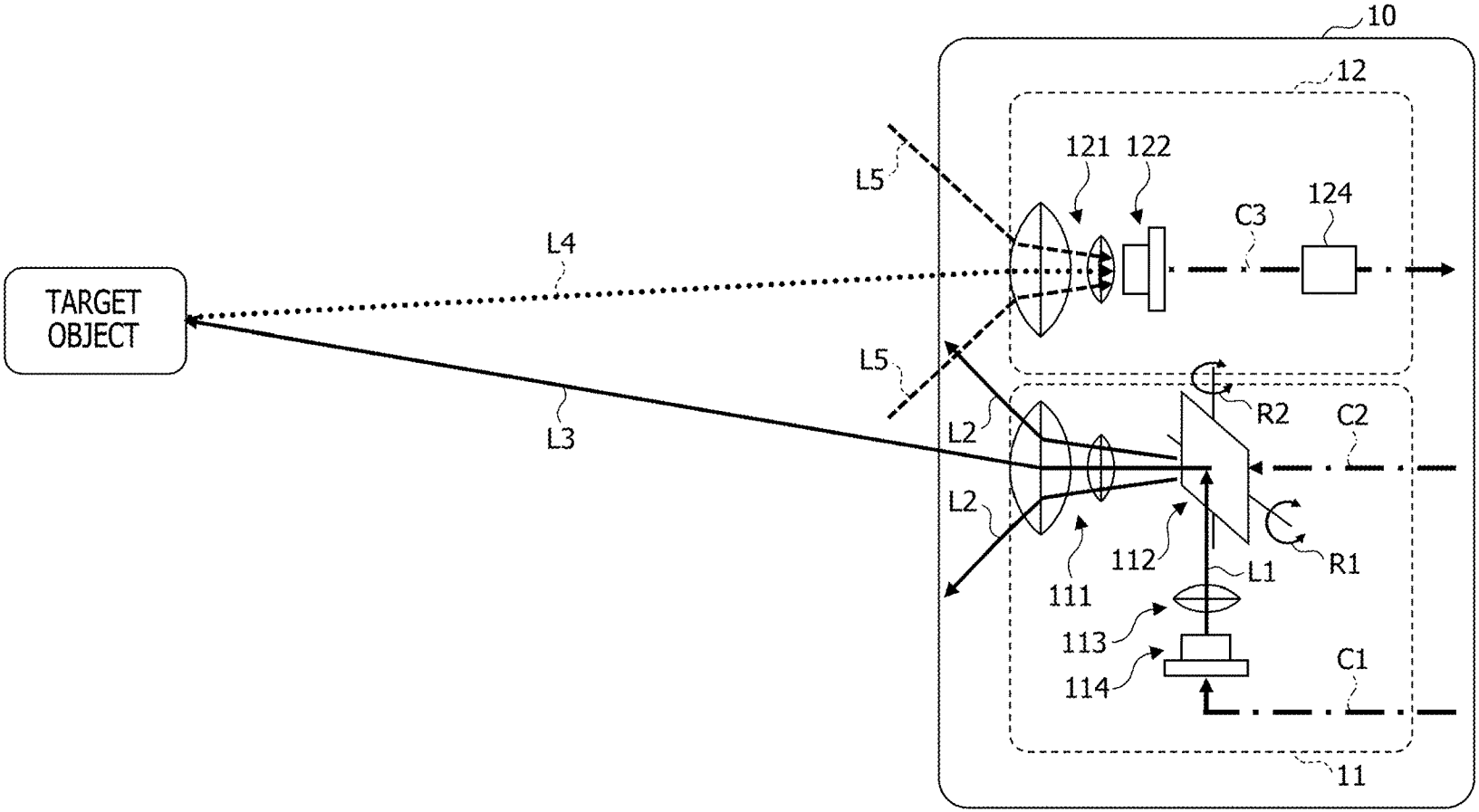
FIG. 1 is a diagram describing a distance measuring apparatus.
Figure 2:
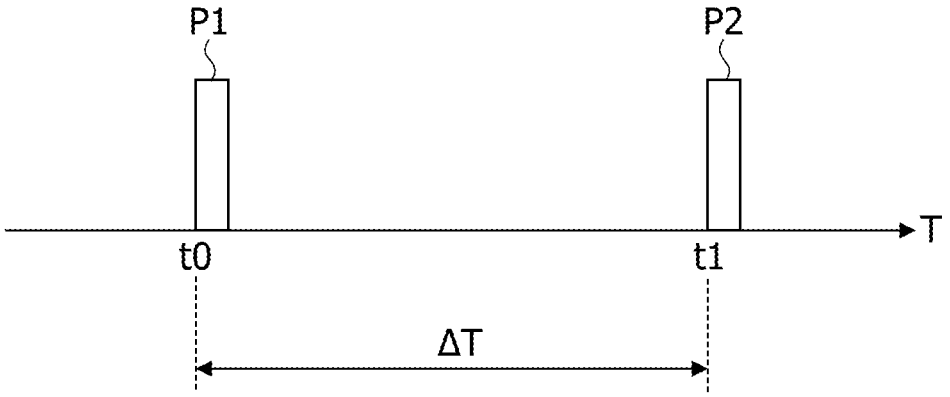
FIG. 2 is a diagram describing a TOF method.

FIG. 1 is a diagram describing the distance measuring apparatus 10 or is a top view schematically illustrating the distance measuring apparatus 10. FIG. 1 schematically illustrates a target object to be subjected to distance measurement.

The distance measuring apparatus 10 is, for example, a laser sensor and includes a light projecting unit 11 and a light receiving unit 12.

The light projecting unit 11 includes a projection lens 111, a microelectromechanical systems (MEMS) mirror 112, a lens 113, and a near-infrared laser light source 114. A driving signal C1 is given to the near-infrared laser light source 114. Laser light emitted by the near-infrared laser light source 114 based on the driving signal C1 hits the MEMS mirror 112 via the lens 113 (refer to an arrow L1). The MEMS mirror 112 is rotatable around two axes perpendicular to each other (refer to arrows R1 and R2), and the laser light is reflected on the MEMS mirror 112 at various angles. The two axes perpendicular to each other are a horizontal axis and a vertical axis. The rotation of the MEMS mirror 112 around the vertical axis enables a scan to be executed in a main scan direction (horizontal direction). In addition, the rotation of the MEMS mirror 112 around the horizontal axis enables the main scan direction to be shifted to an auxiliary scan direction (top-bottom direction). The orientation of the MEMS mirror 112 is changed based on a control signal C2. The control signals C1 and C2 may be generated by a laser driving circuit (not illustrated) and a mirror control circuit (not illustrated) based on instructions from an external (for example, the image information output apparatus (described later)). In this case, the laser driving circuit and the mirror control circuit are included in the light projecting unit 11.

The laser light reflected on the MEMS mirror 112 is output as measurement waves to the outside of the light projecting unit 11 via the projection lens 111. FIG. 1 illustrates a measurement wave L3 and measurement waves L2 related to other directions of the MEMS mirror 112. If a target object exists in a propagation direction of the measurement wave L3, the measurement wave L3 hits the target object, as illustrated in FIG. 1. When the measurement wave L3 hits the target object, the measurement wave L3 is reflected on the target object and directed as a reflected wave L4 toward the light receiving unit 12 and received by the light receiving unit 12. FIG. 1 also illustrates the reflected wave L4 and reflected waves L5 related to the other directions of the MEMS mirror 112.

The light receiving unit 12 includes a light receiving lens 121, a photodiode 122, and a distance measuring circuit 124. The reflected wave L4 is incident on the photodiode 122 via the light receiving lens 121. The photodiode 122 generates an electric signal C3 based on the amount of the incident light and provides the electric signal C3 to the downstream-side distance measuring circuit 124. The distance measuring circuit 124 measures a distance to the target object based on a time period ΔT from the rising of a pulse P1 indicating the time t0 when the laser light is output to the rising of a pulse P2 indicating the time when a reflected wave of the laser light is received. Specifically, the distance to the target object is expressed as follows.

The distance to the target object=(c×ΔT)/2, where c is the speed of light and is approximately 300,000 km/s.

The distance measuring apparatus 10 outputs the laser light based on the pulse P1, measures the time period ΔT of the reciprocation of the laser light to the target object, and calculates the distance by multiplying the time period ΔT by the speed of light. Specifically, the distance measuring distance 10 calculates the distance to the target object with a time-of-flight (TOF) method using the laser light. The distance measuring apparatus 10 provides the obtained result of calculating the distance to the target object to the downstream-side apparatus (image information output apparatus (described later)).

Figure 3:
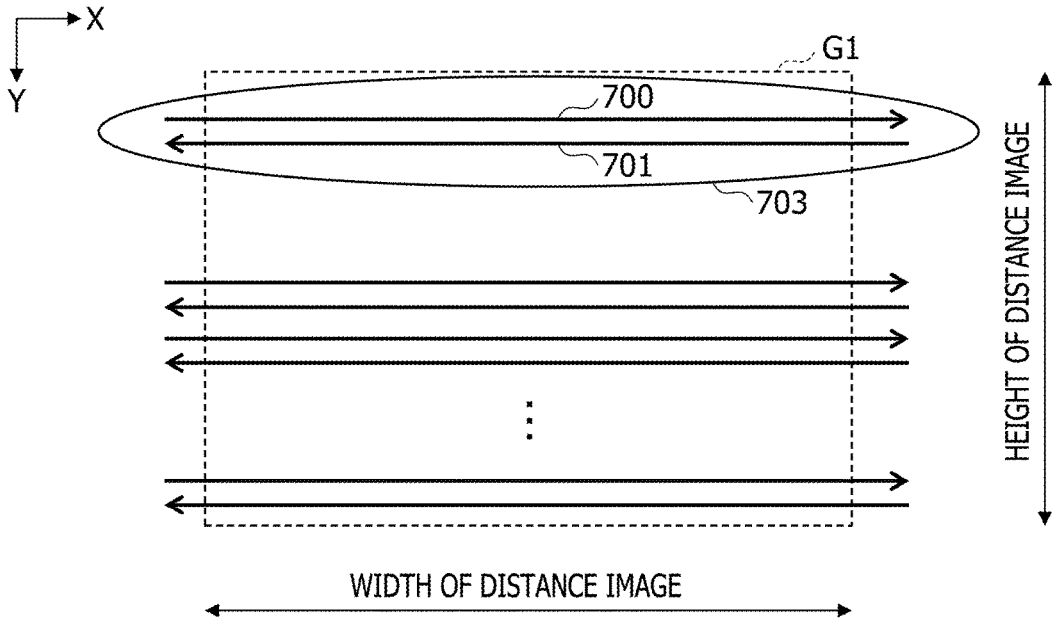
FIG. 3 is a diagram describing a reciprocation scan method to be executed by the distance measuring apparatus using a measurement wave.
Figure 4:
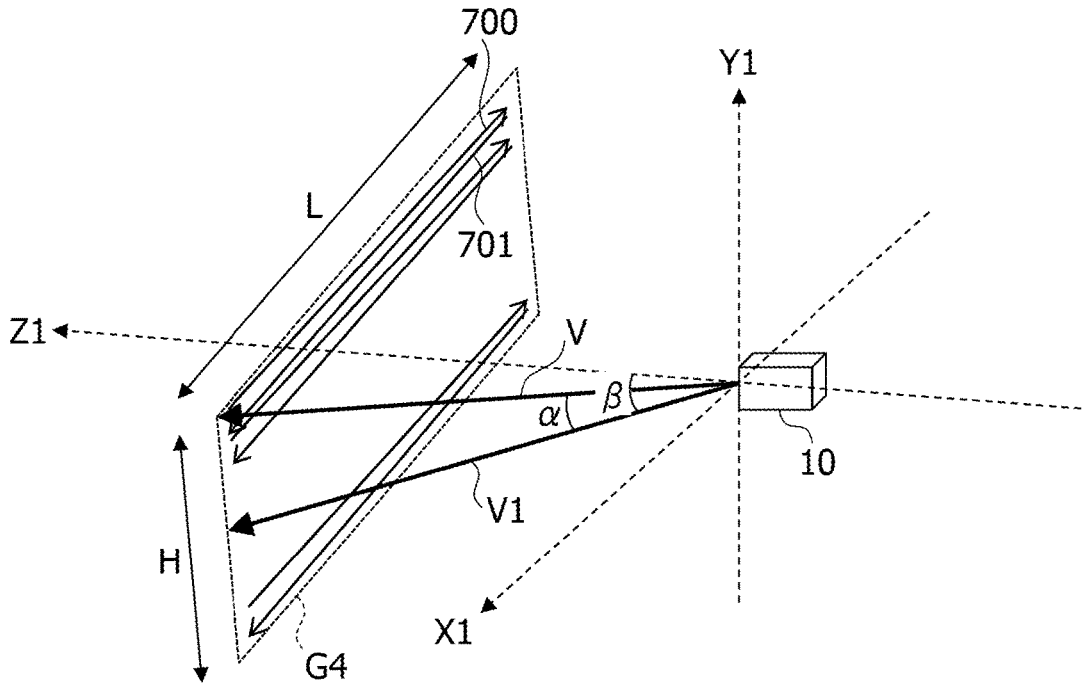
FIG. 4 is a diagram describing the reciprocation scan method to be executed by the distance measuring apparatus using the measurement wave.

FIGS. 3 and 4 are diagrams describing a reciprocation scan method to be executed by the distance measuring apparatus 10 using a measurement wave.

FIG. 3 schematically illustrates a range corresponding to a distance image and indicated by a dotted line G1. FIG. 4 illustrates three axes (X1 axis, Y1 axis, and Z1 axis) perpendicular to each other and extending through the distance measuring apparatus 10 and an entire scan range indicated by a dotted line G4. The scan range G4 corresponds to a range on a virtual screen separated by a predetermined distance from the distance measuring apparatus 10 in the Z1 direction. Specific values of the width L and height H of the scan range G4 are set based on the use of the distance image.

The distance measuring apparatus 10 executes a reciprocation scan with a measurement wave in a scan direction (horizontal direction in this example) and generates distance information items at multiple sampling time points during the reciprocation scan. In FIG. 3, one reciprocation scan is indicated by an ellipse 703, an arrow 700 indicates a scan related to a forward path, and an arrow 701 indicates a scan related to a backward path. The scan related to the forward path and the scan related to the backward scan are executed at substantially the same vertical position. Thus, distance information items for one reciprocation scan may be used to form pixels of one row extending in the horizontal direction in the distance image.

The distance measuring apparatus 10 may execute a scan in the main scan direction (horizontal direction) by rotating around the vertical axis (Y1 axis). In addition, the distance measuring apparatus 10 may rotate around the horizontal axis (X1 axis), thereby shifting the main scan direction to the auxiliary scan direction (top-bottom direction). In FIG. 4, a scan direction at certain sampling time (first sampling for one frame in this example) is indicated by an arrow V. The projection of the arrow V onto a X1Z1 plane is indicated by an arrow V1. An angle $\alpha$ between the arrow V1 and the arrow V indicates a vertical angle in the auxiliary scan direction, while an angle $\beta$ between the arrow V1 and the Z1 axis indicates a horizontal angle in the main scan direction. The horizontal angle $\beta$ is increased in a counterclockwise direction around the Y1 axis (or the horizontal angle $\beta$ is increased on the right side when viewed from the distance measuring device 10 in FIG. 4).

Figure 5:
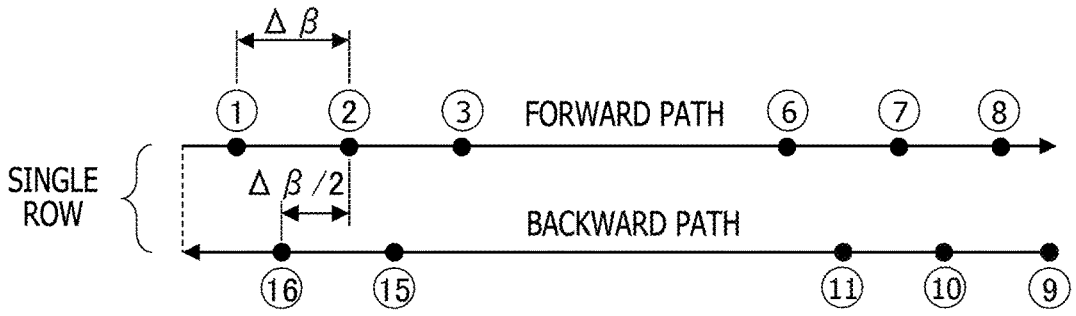
FIG. 5 is a diagram describing numbers (positions of distance information items on forward and backward paths) in a sampling order in one reciprocation scan.

FIG. 5 is a diagram illustrating a part of numbers in a sampling order for one reciprocation scan. In FIG. 5, numbers indicated in circles indicate the sampling order. A smaller number indicated in a circle indicates that the time when sampling is executed is earlier (chronologically earlier). In addition, the positions of the circles schematically indicate adjacency relationships between sampling horizontal angles (described later). An example in which the sampling is executed on a forward path eight times and executed on a backward path eight times is described. In FIG. 5, an illustration of part (e.g., the fourth to fifth sampling indicated by 4 to 5 and the twelfth to fourteenth sampling indicated by 12 to 14) of the sampling is omitted to simplify the description. Actually, the sampling may be executed a large number of times (for example, the sampling is executed on the forward path 160 times and executed on the backward path 160 times). Although the number of times of the sampling executed on the forward path is equal to the number of times of the sampling executed on the backward path in this example, the number of times of the sampling executed on the forward path may be slightly different from the number of times of the sampling executed on the backward path.

Distance information items to be sampled indicate distances related to specific spatial positions (three-dimensional positions). The specific spatial positions are hereinafter referred to as "distance information positions". If the distance information items do not include a background and are obtained, the distance information positions correspond to points at which the laser light is reflected and are, for example, positions on the target object.

Sampling time points for the forward path are set in such a manner that the sampling is executed every time the horizontal angle (angle around the vertical axis) of the MEMS mirror 112 is changed by a certain angle (hereinafter also referred to as "pitch angle $\Delta\beta$"). For example, if the rate of change in the horizontal angle for the forward path is a fixed value, the sampling time points for the forward path are set in such a manner that the sampling is executed at equal time intervals. Similarly, sampling time points for the backward path are set in such a manner that the sampling is executed every time the horizontal angle (angle around the vertical axis) of the MEMS mirror 112 is changed by the certain angle (hereinafter referred to as "pitch angle $\Delta\beta$"). For example, if the rate of change in the horizontal angle for the backward path is a fixed value, the sampling time points for the backward path are set in such a manner that the sampling is executed at equal time intervals.

Horizontal angles of the MEMS mirror 112 at the set sampling time points are referred to as "sampling horizontal angles". In order to obtain distance information items on distance information positions as much as possible for the one reciprocation scan, it is preferable that sampling horizontal angles for the forward path be different from sampling horizontal angles for the backward path. Thus, in the example illustrated in FIG. 5, the sampling horizontal angles for the forward path and the sampling horizontal angles for the backward path are set in such a manner that the sampling horizontal angles for the forward path do not overlap (or are different from) the sampling horizontal angles for the backward path. Specifically, in a regular state, the sampling horizontal angles for the backward path are slightly shifted (by, for example, a half of the pitch angle $\Delta\beta$) from the sampling horizontal angles for the forward scan, as illustrated in FIG. 5. For example, the 16th sampling horizontal angle (for the backward path) is between the 1st and 2nd sampling horizontal angles (for the forward path), and the 15th sampling horizontal angle (for the backward path) is between the 2nd and 3rd sampling horizontal angles (for the forward path). The same applies the other horizontal sampling angles.

The MEMS mirror 112 is driven in such a manner that the horizontal angle of the MEMS mirror 112 is changed over time in accordance with a sine wave, for example. In this case, the sampling horizontal angles for the forward and backward paths may be set based on the driving signal C2 given to the MEMS mirror 112. Alternatively, if the MEMS mirror 112 outputs a horizontal angle signal (not illustrated) indicating the horizontal angle, the sampling horizontal angles for the forward and backward paths may be set based on the horizontal angle signal obtained from the MEMS mirror 112. The sampling horizontal angles may be set in a range of all horizontal angles, excluding the maximum and minimum horizontal angles of the MEMS mirror 112, of the MEMS mirror 112 in a reciprocation scan, for example.

The cause and the like of deviations in adjacency relationships between pixel value information items in the scan direction are described with reference to FIGS. 6 to 10.

Figure 6:
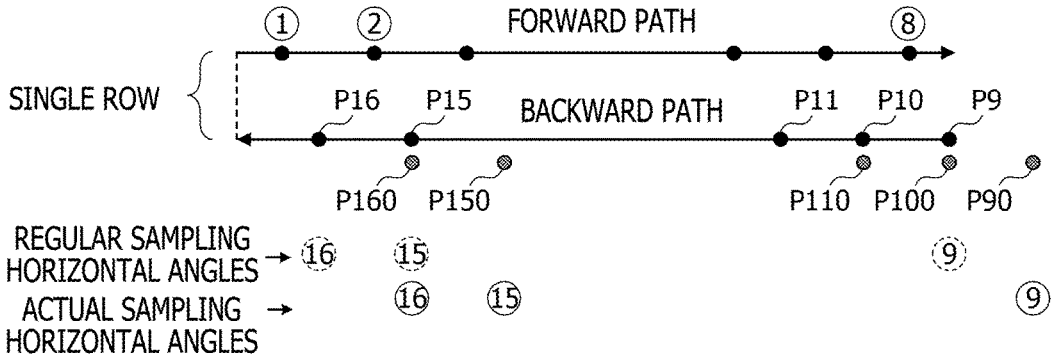
FIG. 6 is a diagram describing deviations in adjacency relationships between distance information items of a pixel row.

FIG. 6 is a diagram describing deviations, causing deviations in adjacency relationships between pixel value information items in the scan direction, in adjacency relationships between sampling horizontal angles. FIG. 6 illustrates, in comparison, a state (or nominal state) in which there is not a deviation in adjacency relationships between sampling horizontal angles and a state in which there are deviations in adjacency relationships between sampling horizontal angles. A deviation in an adjacency relationship between sampling horizontal angles indicates a "deviation of an adjacency relationship of an actual sampling horizontal angle in the horizontal direction from an adjacency relationship of a regular sampling horizontal angle in the horizontal direction".

In FIG. 6, numbers indicated in white circles indicate a sampling order, and the positions of the white circles schematically indicate corresponding sampling horizontal angles. As the position of a white circle is closer to the leftmost position, the white circle indicates a smaller sampling horizontal angle. The positions of black circles indicated by P# (# indicates numbers) schematically indicate corresponding sampling horizontal angles, like the positions of the white circles. As the position of a black circle is closer to the leftmost position, the black circle indicates a smaller sampling horizontal angle. P9, P10, P11, P15, and P16 indicate the 9th, 10th, 11th, 15th, and 16th regular sampling horizontal angles, respectively. In addition, P90, P100, P110, P150, and P160 indicate the 9th, 10th, 11th, 15th, and 16th actual sampling horizontal angles, respectively.

As described above, the sampling horizontal angles for the backward path are slightly shifted from the sampling horizontal angles for the forward path based on the design of the distance measuring apparatus 10 (refer to FIG. 5). Thus, in a state in which there is not a deviation in adjacency relationships between the sampling horizontal angles, the sampling horizontal angles for the backward path and the sampling horizontal angles for the forward path are alternately set.

The actual sampling horizontal angles, however, may deviate from the regular sampling horizontal angles (nominal sampling horizontal angles based on the design), as illustrated in FIG. 6. Specifically, since the actual sampling horizontal angles are determined based on the electric signal (for example, the horizontal angle signal) indicating the state of the MEMS mirror 112 as described above, the actual sampling horizontal angles may be affected by noise or the like and deviate from the regular sampling horizontal angles. For example, the actual sampling horizontal angles may deviate from the regular sampling horizontal angles due to variations in the amplitudes of the pulses (pulses of the driving signals C1 and C2) to be used to operate the near-infrared laser light source 114 and the MEMS mirror 112, noise of the horizontal angle signal, or the like.

FIG. 6 illustrates a state in which the actual sampling horizontal angles for the forward path deviate from the regular sampling horizontal angles for the forward path in the counterclockwise direction. In the example illustrated in FIG. 6, the 16th sampling horizontal angle (for the backward path) is not between the 1st and 2nd sampling horizontal angles (for the forward path) and is between the 2nd and 3rd sampling horizontal angles (for the forward path). In addition, the 15th sampling horizontal angle (for the backward path) is between the 3rd and 4th sampling horizontal angles (for the forward path). In the example illustrated in FIG. 6, the actual sampling horizontal angles for the forward path deviate by one pitch angle $\Delta\beta$ from the regular sampling horizontal angles for the forward path in the counterclockwise direction.

The significant deviations of the actual sampling horizontal angles from the regular sampling horizontal angles may cause deviations in adjacency relationships of the actual sampling horizontal angles from adjacency relationships of the regular sampling horizontal angles and cause "deviations in adjacency relationships between pixel value information items" within pixel rows, as described later.

Figure 7:
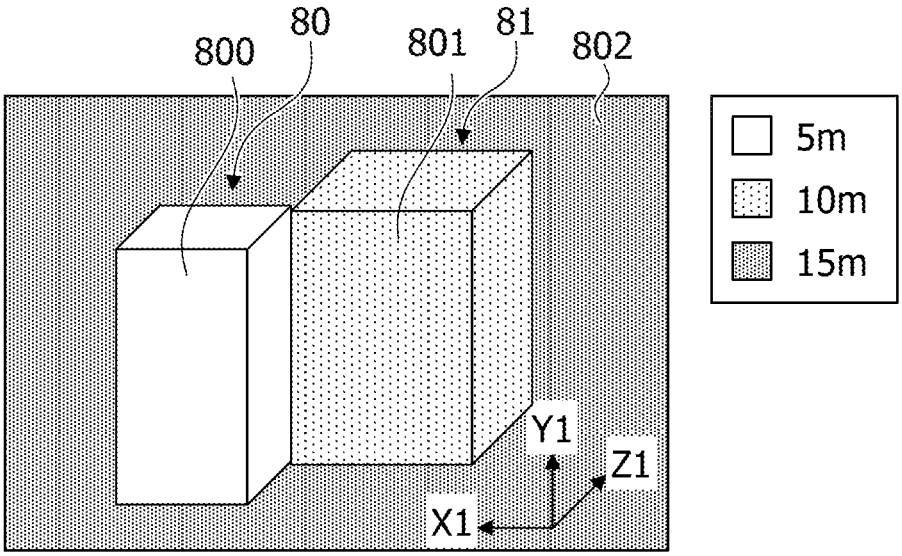
FIG. 7 is a diagram illustrating an example of a distance measurement state assumed for description purposes.

For example, it is assumed that distances are measured in a state illustrated in FIG. 7. In FIG. 7, the distances are indicated by gray scale levels for description purposes. In FIG. 7, as a gray scale level is higher, a distance indicated by the gray scale level is longer (the same applies FIGS. 8 and 10 described later). A surface 800 (perpendicular to the Z1 axis) of an object 80 is closest to the distance measuring apparatus 10 and separated by, for example, 5 meters from the distance measuring apparatus 10. A surface 801 (perpendicular to the Z1 axis) of an object 81 is second closest to the distance measuring apparatus 10 and separated by, for example, 10 meters from the distance measuring apparatus 10. An object 802 is farthest from the distance measuring apparatus 10 and separated by, for example, 15 meters from the distance measuring apparatus 10.

Figure 8:
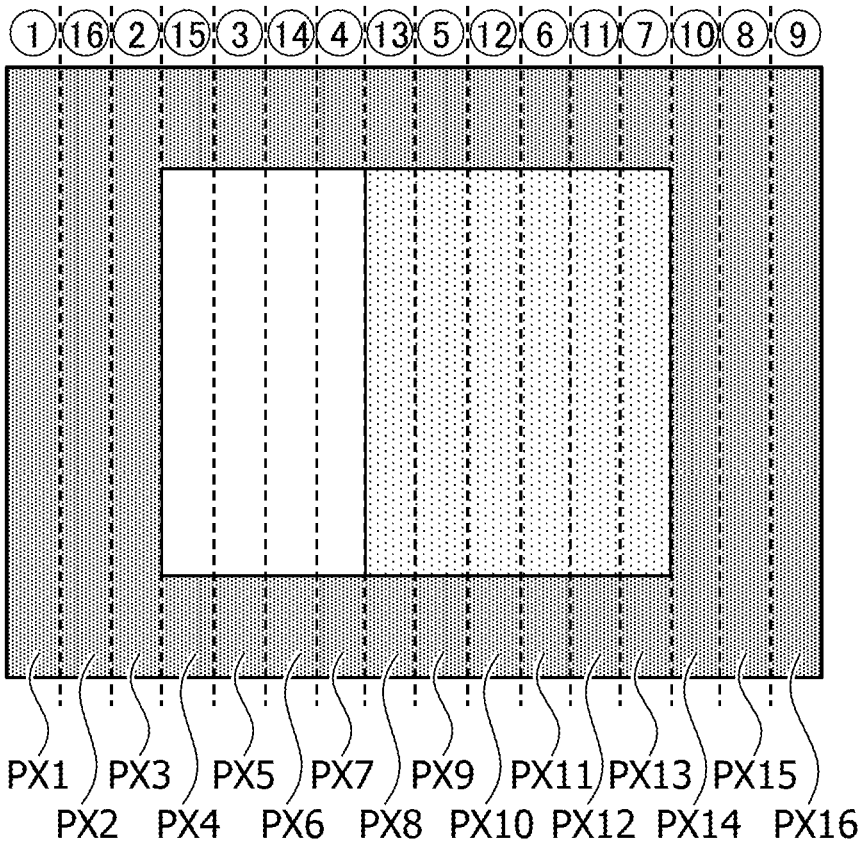
FIG. 8 is a diagram illustrating an example of an ideal distance image obtained in the state illustrated in FIG. 7.

If a distance image is generated in accordance with a chronological order of distance information items that do not have a deviation in adjacency relationships between sampling horizontal angles in the state illustrated in FIG. 7, the distance image may be an image illustrated in FIG. 8.

FIG. 8 illustrates dotted lines and circles that indicate numbers in a sampling order in which pixels of the distance image are formed based on distance information items obtained in the sampling order for description purposes. The dotted lines indicate boundaries between pixels arranged in the horizontal direction in the distance image, while numbers indicated in the circles indicate the sampling order. A smaller number indicated in a circle is smaller indicates that the time when the sampling is executed is earlier (chronologically earlier). In this example, the distance image illustrated in FIG. 8 has 16 pixels (PX1 to PX16) in the horizontal direction for description purposes. Actually, the distance image has a larger number of pixels. In addition, actually, since the distance image has multiple pixels in the vertical direction, deviations in adjacency relationships between sampling horizontal angles in reciprocation scans executed on multiple pixel rows extending in the horizontal direction may be different from each other. For example, there may be a case where, while there is not a deviation in an adjacency relationship between sampling horizontal angles in one reciprocation scan executed on a certain pixel row, there is a deviation in an adjacency relationship between sampling horizontal angles in one reciprocation scan executed on another pixel row. FIG. 8, however, assumes that there is not a deviation in adjacency relationships between sampling horizontal angles in reciprocation scans executed on pixel rows extending in the horizontal direction for description purposes.

When distance information items are obtained in the state in which there is not a deviation in the adjacency relationships between the sampling horizontal angles, an appropriate distance image may be obtained by assigning, in a chronological order, the distance information items to the pixels PX1 to PX16 arranged in the horizontal direction without a change (or without correction), as illustrated in FIG. 8. A method of assigning distance information items for one reciprocation scan to pixels arranged in a single row in the horizontal direction based on adjacency relationships between regular sampling horizontal angles in the scan direction (without correction) is hereinafter referred to as "normal assignment method".

Specifically, the normal assignment method is as follows. In the normal assignment method, a chronological distance information item on a forward path is assigned to every two pixels (PX1, PX3, PX5, . . . in FIG. 8) in the order from a pixel existing on the leftmost side (side on which sampling for the forward path is started). In addition, in the normal assignment method, a chronological distance information items on a backward path is assigned to every two pixels (remaining pixels) (PX16, PX14, PX12, . . . in FIG. 8) in the order from a pixel existing on the rightmost side (side on which sampling for the backward path is started). As described above, in the normal assignment method, it is assumed that distance information items are obtained in a state in which there is not a deviation in adjacency relationships between sampling horizontal angles. Thus, in the normal assignment method, an appropriate distance image is obtained as long as there is not a deviation in adjacency relationships between sampling horizontal angles.

On the other hand, it is assumed that there are deviations in adjacency relationships between sampling horizontal angles as illustrated in FIG. 6 in the state illustrated in FIG. 7.

FIG. 9 is a table diagram describing a state (state illustrated in FIG. 6) in which deviations in adjacency relationships between sampling horizontal angles exist. In FIG. 9, numbers indicated in circles indicate a sampling order. A smaller number indicated in a circle indicates that the time when the sampling is executed is earlier (chronologically earlier). The positions of the numbers indicated in the circles in the table diagram indicate actual sampling horizontal angles corresponding to the numbers in the sampling order.

Horizontal angles β1 to β16 are regular sampling horizontal angles. If there is not a deviation in adjacency relationships between sampling horizontal angles, the regular sampling horizontal angles and the numbers in the sampling order have correspondence relationships indicated by "without deviation" in FIG. 9.

As indicated by "with deviations" in FIG. 9, there are deviations in adjacency relationships between sampling horizontal angles. Specifically, only sampling horizontal angles for the backward path that are among sampling horizontal angles for the forward and backward paths during a single reciprocation scan deviate from regular sampling horizontal angles.

The deviations of the sampling horizontal angles for the backward path are nearly uniform and larger than a half of one pitch angle Δβ to be used to change sampling horizontal angles. For example, a sampling horizontal angle in the 10th sampling is β16 and different from the regular sampling horizontal angle β14, or β16>β14+βΔ/2 (thus β16>β15).

Thus, adjacency relationships of the sampling horizontal angles for the backward path deviate by one with respect to relationships with the sampling horizontal angles for the forward path, as indicated by "with deviations" in FIG. 9. Specifically, in the regular state, the sampling horizontal angle in the 16th sampling has an adjacency relationship with and is adjacent to the 1st and 2nd sampling horizontal angles for the forward path. As indicated by "with deviations" in FIG. 9, if the deviations exist, the adjacency relationship deviates. Specifically, as indicated by "with deviations" in FIG. 9, if the deviations exist, the 16th sampling horizontal angle has an adjacency relationship with and is adjacent to the 2nd and 3rd sampling horizontal angles for the forward path. In FIG. 9, adjacency relationships of the sampling horizontal angles for the backward path deviate by one with respect to the relationships with the sampling horizontal angles for the forward path. However, the sampling horizontal angles for the backward path may deviate by two or more with respect to the relationships with the sampling horizontal angles for the forward path.

Figure 10:
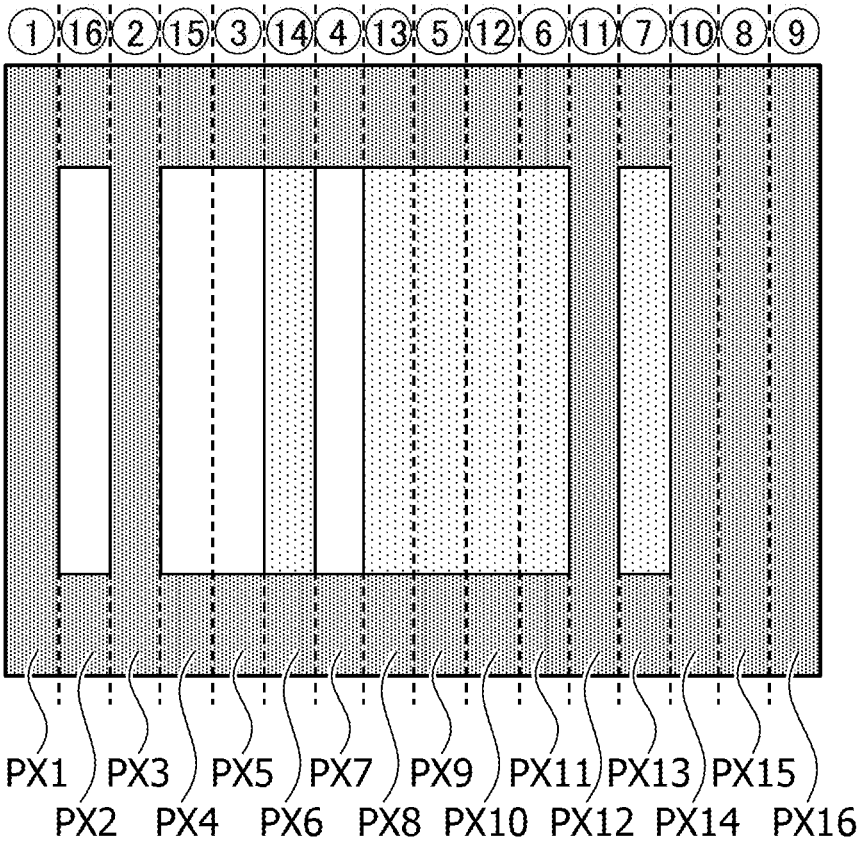
FIG. 10 is a diagram describing a distance image obtained using a normal assignment method in the case where the deviations in the adjacency relationships between the sampling horizontal angles illustrated in FIG. 9 in the state illustrated in FIG. 7 exist.

If a distance image is formed using the normal assignment method based on distance information items obtained in the state in which there are the deviations in the adjacency relationships between the sampling horizontal angles, the distance image may be an image illustrated in FIG. 10. Actually, as described above, deviations in adjacency relationships between sampling horizontal angles in reciprocation scans executed on multiple pixel rows extending in the horizontal direction may be different from each other. For example, while deviations in adjacency relationships between sampling horizontal angles in one reciprocation scan executed on a certain single pixel row may occur in a first manner, deviations in adjacency relationships between sampling horizontal angles in one reciprocation scan executed on another single pixel row may occur in a second manner different from the first manner. FIG. 10, however, assumes that deviations in adjacency relationships between sampling horizontal angles in all reciprocation scans executed on pixel rows extending in the horizontal direction occur in the same manner for description purposes.

Specifically, in the normal assignment method, as illustrated in FIG. 10, a chronological distance information item on the backward path is assigned to every two pixels (remaining pixels) (PX16, PX14, PX12, . . . in FIG. 10) in the order from a pixel existing on the rightmost side (side on which sampling for the backward path is started). For example, a distance information item obtained at the 16th sampling horizontal angle β4 is not assigned to a pixel PX4 located between pixels PX3 and PX5 and is assigned to a pixel PX2 located between pixels PX1 and PX3, regardless of an inequality of β3<β4<β5. As a result, a distance image having "deviations in adjacency relationships between pixel value information items" within pixel rows is obtained, as illustrated in FIG. 10. The distance image illustrated in FIG. 10 has the "deviations in the adjacency relationships between the pixel value information items" within all the pixel rows.

The "deviations in the adjacency relationships between the pixel value information items" within the pixel rows are defined as follows. It is assumed that a horizontal pixel position (X coordinate) located within the distance image and associated with a distance information item obtained at a sampling horizontal angle β2 between two sampling horizontal angles β1 and β3 is PX2. In addition, it is assumed that horizontal pixel positions located within the distance image and associated with distance information items obtained at sampling horizontal angles β1 and β3 are PX1 and PX3. In this case, a deviation in an adjacency relationship between pixel value information items within a pixel row indicates a state in which an inequality of PX1<PX2<PX3 is not established. The deviation in the adjacency relationship between the pixel value information items within the pixel row occurs when the actual sampling horizontal angle β2 is not between the sampling horizontal angles β1 and β3 and is smaller than the sampling horizontal angle β1 or larger than the sampling horizontal angle β3, for example.

As described above, when an actual sampling horizontal angle significantly deviates from a regular sampling horizontal angle, a deviation in an adjacency relationship between the sampling horizontal angles occurs. When a deviation in an adjacency relationship between sampling horizontal angles occurs, a deviation in an adjacency relationship between pixel value information items occurs as described above in the normal assignment method. A deviation in an adjacency relationship between sampling horizontal angles occurs when an actual sampling horizontal angle significantly deviates from a regular sampling horizontal angle only during a part (for example, a scan for a backward path) of a time period of one reciprocation scan. If actual sampling horizontal angles uniformly deviate from regular sampling horizontal angles during an entire single reciprocation scan, a deviation in an adjacency relationship between sampling horizontal angles does not occur.

Next, the image information output apparatus is described with reference to FIG. 11 and later.

The image information output apparatus 100 outputs image information such as a distance image based on distance information items obtained from the aforementioned distance measuring apparatus 10. The image information output apparatus 100 may collaborate with the distance measuring apparatus 10 to form a system.

The image information output apparatus 100 may be achieved by a computer connected to the distance measuring apparatus 10. The connection between the image information output apparatus 100 and the distance measuring apparatus 10 may be achieved by a wired communication path, a wireless communication path, or a combination of wired and wireless communication paths. For example, if the image information output apparatus 100 is a server installed relatively remotely from the distance measuring apparatus 10, the image information output apparatus 100 may be connected to the distance measuring apparatus 10 via a network. In this case, the network may include a wireless communication network for mobile phones, the Internet, a world wide web, a virtual private network (VPN), a wide area network (WAN), a cable network, or an arbitrary combination of two or more thereof. If the image information output apparatus 100 is installed relatively near the distance measuring apparatus 10, a wireless communication path between the image information output apparatus 100 and the distance measuring apparatus 10 may be achieved by near field communication, Bluetooth (registered trademark), Wireless Fidelity (Wi-Fi), or the like.

Figure 11:
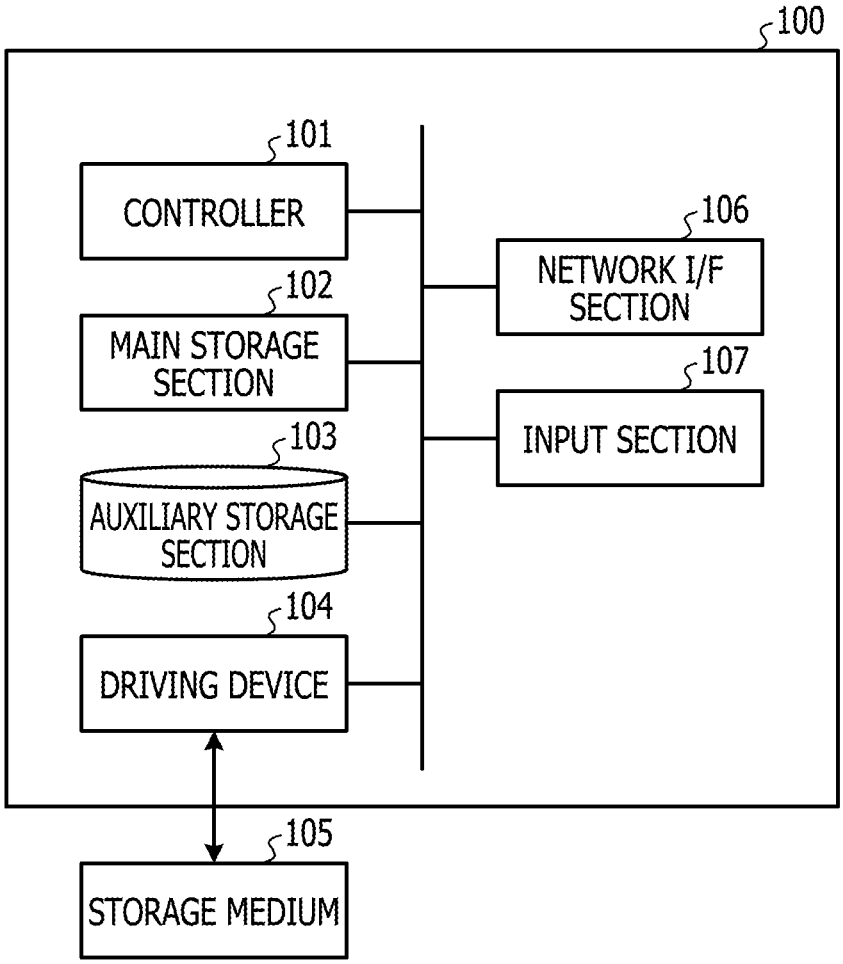
FIG. 11 is a diagram illustrating an example of a hardware configuration of an image information output apparatus.

FIG. 11 is a diagram illustrating an example of a hardware configuration of the image information output apparatus 100.

In the example illustrated in FIG. 11, the image information output apparatus 100 includes a controller 101, a main storage section 102, an auxiliary storage section 103, a driving device 104, a network interface (I/F) section 106, and an input section 107.

The controller 101 is an arithmetic device that executes programs stored in the main storage section 102 and the auxiliary storage section 103. The controller 101 receives data from the input device 107 and a storage device, calculates and processes the data, and outputs the data to the storage device and the like.

The main storage section 102 is a read only memory (ROM), a random access memory (RAM), or the like. The main storage section 102 is a storage device that stores or temporarily stores data, programs such as application software, and programs such as an operating system (OS) that is basic software to be executed by the controller 101.

The auxiliary storage section 103 is a hard disk drive (HDD) or the like. The auxiliary storage section 103 is a storage device that stores data on the application software and the like.

The driving device 104 reads a program from a storage medium 105 such as a flexible disk and installs the read program in a storage device, for example.

The storage medium 105 stores a predetermined program. The program stored in the storage medium 105 is installed in the image information output apparatus 100 via the driving device 104. The installed predetermined program may be executed by the image information output apparatus 100.

The network I/F section 106 is an interface between the image information output apparatus 100 and a peripheral device (for example, the distance measuring apparatus 10) having a communication function and connected to the image information output apparatus 100 via a network configured with a data transmission path such as a wired line, a wireless line, or a combination of wired and wireless lines.

The input section 107 is cursor keys, a keyboard provided with a numeric keypad, various functional keys, and the like, a mouse, a touch pad, or the like.

In the example illustrated in FIG. 11, various processes described later and the like may be achieved by causing the image information output apparatus 100 to execute a program. In addition, the various processes described later and the like may be achieved by storing the program in the storage medium 105 and causing the image information output apparatus 100 to read the program from the storage medium 105. As the storage medium 105, various types of storage media may be used. For example, the storage medium 105 may be a storage medium that optically, electrically, or magnetically stores information and is a compact disc-ROM (CD-ROM), a flexible disk, a magneto-optical disc, or the like, a semiconductor memory that electrically stores information and is a ROM, a flash memory, or the like, or the like. The storage medium 105 is not a carrier wave.

Figure 12:
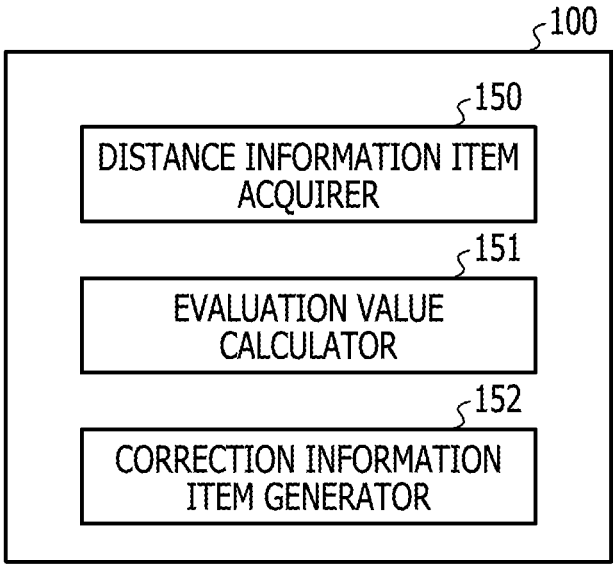
FIG. 12 is a diagram illustrating an example of functional blocks of the image information output apparatus.

FIG. 12 is a diagram illustrating an example of functional blocks of the image information output apparatus 100.

The image information output apparatus 100 includes a distance information item acquirer 150 (an example of a pixel value information acquirer), an evaluation value calculator 151 (an example of a calculator), and a correction information item generator 152. The distance information item acquirer 150, the evaluation value calculator 151, and the correction information item generator 152 may be achieved by causing the controller 101 illustrated in FIG. 11 to execute one or more programs stored in a storage device (for example, the main storage section 102).

The distance information item acquirer 150 acquires distance information items from the distance measuring apparatus 10 via, for example, the network I/F section 106. The distance information item acquirer 150 may acquire the distance information items from the distance measuring apparatus 10 via the storage medium 105 or the driving device 104. In this case, the distance information items to be acquired from the distance measuring apparatus 10 are stored in the storage medium 105 or the driving device 104 in advance.

The evaluation value calculator 151 calculates evaluation values related to a "deviation in adjacency relationships between pixel value information items" in the aforementioned scan direction for each reciprocation scan. The evaluation values are related to consistency between adjacency relationships between multiple sampling horizontal angles in the horizontal direction and adjacency relationships between distance information items in the horizontal direction in a distance image. If there is the consistency between the adjacency relationships between the sampling horizontal angles in the horizontal direction and the adjacency relationships between the distance information items in the horizontal direction in the distance image, there is not a "deviation in the adjacency relationships between the pixel value information items" in the aforementioned scan direction.

Specifically, the evaluation value calculator 151 calculates evaluation values in the case where distance information items for one reciprocation scan are assigned to pixels of the distance image by a predetermined assignment method. Each of the evaluation values indicates whether or not there is a "deviation in an adjacency relationship between pixel value information items" within a pixel row in the distance image obtained as a result of the assignment. For example, each of the evaluation values may be a parameter that becomes larger as a "deviation in an adjacency relationship between pixel value information items" within a pixel row becomes larger. In this case, the smallest evaluation value may be handled as a value indicating that there is not a "deviation in an adjacency relationship between pixel value information items" within a pixel row. Alternatively, each of the evaluation values may be a parameter that becomes smaller as a "deviation in an adjacency relationship between pixel value information items" within a pixel row becomes larger in the distance image obtained as a result of the assignment. In this case, the largest evaluation value may be handled as a value indicating that there is not a "deviation in an adjacency relationship between pixel value information items" within a pixel row. The evaluation values are arbitrary as long as each of the evaluation value indicates whether or not there is a deviation in an adjacency relationship between pixel value information items" within a pixel row in the distance image obtained as a result of the assignment.

When a "deviation in an adjacency relationship between pixel value information items" in the scan direction occurs, an adjacency relationship between a chronological distance information item on a forward path and a reverse-chronological distance information item on a backward path is different from a regular adjacency relationship, as described above. In a distance image obtained as a result of the deviation, a characteristic change (increase or reduction) in a difference between distance information items in the horizontal direction appears. For example, in the distance image illustrated in FIG. 10, a vertical stripe (continuity of two edges in the horizontal direction) related to the pixel PX2 appears due to the pixel PX2 located between the pixels PX1 and PX3. In addition, a vertical stripe related to a pixel PX6 appears due to the pixel PX6 located between the pixels PX5 and PX7. Furthermore, a vertical stripe related to a pixel PX12 appears due to the pixel PX12 located between the pixels PX11 and PX13. A vertical stripe relatively hardly occurs in a distance image that does not have a "deviation in adjacency relationships between pixel value information items" within pixel rows (refer to FIG. 8). It is, therefore, apparent that an evaluation value related to the difference between two adjacent distance information items (distance information items on forward and backward paths) may be effectively used as an evaluation value indicating whether or not there is a "deviation in an adjacency relationship between pixel value information items" within a pixel row.

The predetermined assignment method is to mostly alternately assign chronological distance information items on a forward path and reverse-chronological distance information items on a backward path to pixels PX1 to PX16 arranged in a single row in a distance image in the order from the pixel PX1 to the PX16. "Mostly alternately assigning the distance information items" indicates that it is acceptable for a distance information item on the forward path and a distance information item on the backward path not to be alternately assigned to pixels included in an edge portion of the distance image in the horizontal direction as a result of a "deviation caused by a change in the assignment method" as described later. The evaluation value calculator 151 calculates evaluation values for each of multiple predetermined assignment methods.

The multiple predetermined assignment methods include the aforementioned normal assignment method and methods (hereinafter referred to as "correction assignment methods") of assigning distance information items on forward and backward paths to pixels in such a manner that pixels are shifted toward an arbitrary side in the horizontal direction in a distance image.

FIG. 13 is a table diagram describing the correction assignment methods. FIG. 13 describes the normal assignment method and different two correction assignment methods. In FIG. 13, "pixels targeted for assignment" indicate the pixels PX1 to PX16 arranged in the single row in the distance image, and numbers indicated in circles indicate a sampling order. The positions of the numbers indicated in the circles in the table diagram indicate "pixels targeted for assignment" and having assigned thereto distance information items corresponding to numbers in the sampling order. For example, in a first correction assignment method (No. 1), a distance information item on the 13th sampling is assigned to the pixel PX6. In a second correction assignment method (No. 2), the distance information item on the 13th sampling is assigned to the pixel PX10. In the normal assignment method, the distance information item on the 13th sampling is assigned to the pixel PX8.

In the example illustrated in FIG. 13, in the first correction assignment method (No. 1), pixels to which distance information items on the backward path are assigned are shifted by only one toward the left side in the horizontal direction in the distance image, compared with the normal assignment method. In the second correction assignment method (No. 2), the pixels to which the distance information items on the backward path are assigned are shifted by only one toward the right side in the horizontal direction in the distance image, compared with the normal assignment method. Since a pixel is not assigned to chronologically first or last one or more distance information items among the distance information items on the backward path as a result of the shifting in the assignment, compared with the normal assignment method, the chronologically first or last one or more distance information items are ignored. For example, in the first correction assignment method (No. 1), since a pixel is not assigned to a distance information item on the 16th sampling, the distance information item on the 16th sampling is ignored. In addition, since a distance information item to be assigned to a pixel included in any of the edge portions of the distance image does not exist, an appropriate predetermined distance information item (refer to "*" in FIG. 13) may be assigned to the pixel. The predetermined distance information item may be generated based on distance information items on an adjacent forward path. For example, in the second correction assignment method (No. 2), since a distance information item to be assigned to the pixel PX2 included in the left edge portion of the distance image does not exist, a distance information item assigned to the pixel PX1 or PX3, an average of distance information items assigned to the pixels PX1 and PX3, or the like may be assigned as the predetermined distance information item to the pixel PX2. Alternatively, as the predetermined distance information item, the original distance information item before the shifting may be used. For example, in the first correction assignment method (No. 1), a distance information item (distance information item on the 9th sampling) before the shifting may be assigned as the predetermined distance information item to the pixel PX16 included in the right edge portion of the distance image.

The example illustrated in FIG. 13 also describes a third correction assignment method (No. 3). In the third correction assignment method (No. 3), the pixels to which the distance information items on the backward path are assigned are shifted by two toward the left side in the horizontal direction in the distance image, compared with the normal assignment method. In the example illustrated in FIG. 13, the three correction assignment methods are set, but only one or two of the correction assignment methods may be set or four or more correction assignment methods may be set.

Hereinafter, shifting, by one, each of pixels to which distance information items on a backward path are assigned in the first correction assignment method (No. 1) and the second correction assignment method (No. 2), compared with the normal assignment method, is also indicated by the fact that a "shifting number is 1". Thus, since the pixels to which the distance information items on the backward path are assigned are shifted by two in the third correction assignment method (No. 3), compared with the normal assignment method, the "shifting number is 2". The shifting number corresponds to the number of times that pixels to which distance information items on the backward path are assigned are shifted one by one in the certain direction, compared with the normal assignment method.

The evaluation value calculator 151 calculates evaluation values for each of the multiple predetermined assignment methods as described above. In the case where the predetermined assignment methods are different from each other, adjacency relationships between chronological distance information items on a forward path and reverse-chronological distance information items on a backward path in one of the predetermined assignment methods are changed from adjacency relationships between the chronological distance information items on the forward path and the reverse-chronological distance information items on the backward path in another one of the predetermined assignment methods. Specifically, for example, while a distance information item on the 7th sampling (for the forward path) has an adjacency relationship with and is adjacent to distance information items on the 11th and 10th sampling (for the backward path) in the normal assignment method, the distance information item on the 7th sampling (for the forward path) has a different adjacency relationship in each of the correction assignment methods. For example, in the first correction assignment method (No. 1), the distance information item on the 7th sampling (for the forward path) has an adjacency relationship with and is adjacent to the distance information items on the 10th and 9th sampling (for the backward path). In the second correction assignment method (No. 2), the distance information item on the 7th sampling (for the forward path) has an adjacency relationship with and is adjacent to the distance information items on the 12th and 11th sampling (for the backward path).

Since the adjacency relationships between the chronological distance information items on the forward path and the reverse-chronological distance information items on the backward path are changed in the aforementioned manner, the probabilities or degrees of "deviations in adjacency relationships between pixel value information items" within pixel rows may be detected with high accuracy. The evaluation value calculator 151 may not generate a single row of a distance image to be subjected to the assignment methods upon the calculation of evaluation values for the normal assignment method and the correction assignment methods, and it is sufficient if the evaluation value calculator 151 virtually reproduces a single row of the distance image to be subjected to the assignment methods and calculates the evaluation values.

The correction information item generator 152 compares the evaluation values calculated by the evaluation value calculator 151 for the multiple assignment methods with each other for each reciprocation scan and generates a correction information item on distance information items for each reciprocation scan based on the evaluation values. Each of the correction information items is generated based on the best evaluation value among evaluation values for each reciprocation scan. Specifically, each of the correction information items is generated based on an evaluation value indicating that there is not a "deviation in an adjacency relationship between pixel value information items" with a pixel row. For example, if each of the evaluation values is a parameter that becomes larger as a "deviation in an adjacency relationship between pixel value information items" within a pixel row becomes larger, each of the correction information items is generated based on the smallest evaluation value among the evaluation values.

Each of the correction information items may be information directly or indirectly indicating an assignment method (or an arrangement order in which pixel value information items are arranged) that does not cause a "deviation in an adjacency relationship between pixel value information item" within a pixel row. The correction information items, each of which directly or indirectly indicates an assignment method that does not cause a "deviation in an adjacency relationship between pixel value information items" within a pixel row, may be distance information items modified in such a manner that even if the assignment is executed using the normal assignment method, a "deviation in an adjacency relationship between pixel value information items" within a pixel row does not occur. The modified distance information items may be generated as follows in the example illustrated in FIG. 9. First, a distance information item on the 9th sampling is deleted from the original distance information items for the single reciprocation scan, and the sampling order of the other distance information items is moved up. Then, an appropriate distance information item (for example, the same distance information item as the distance information item on the 1st or 2nd sampling) is given as the distance information item on the 16th sampling.

Alternatively, the correction information items may be a distance image obtained by executing the assignment using an assignment method that does not cause a "deviation in an adjacency relationship between pixel value information" within a pixel row.

According to the embodiment, a distance image that does not have a deviation in an adjacency relationship between pixel value information items may be obtained. Specifically, according to the embodiment, evaluation values, each of which indicates whether or not there is a "deviation in an adjacency relationship between pixel value information items" within a pixel row, are calculated for each of the multiple predetermined methods. In this case, an assignment method for which evaluation values that indicate that there is not a "deviation in an adjacency relationship between pixel value information items" are calculated is an assignment method that does not cause a "deviation in an adjacency relationship between pixel value information items". Thus, a distance image that does not have a deviation in an adjacency relationship between pixel value information items may be obtained based on a correction information item indicating an assignment method that does not cause a "deviation in an adjacency relationship between pixel value information items".

The distance information items are used as pixel value information items in the embodiment, but the embodiment is not limited to this. For example, pixel value information items (information items of the amounts or intensities of the light) based on the amounts of the light received by the light receiving unit 12 or the like may be used instead of the distance information items.

Next, several operational examples of the image information output apparatus 100 are described with reference to FIG. 14 and later.

First Operational Example

Figure 14:
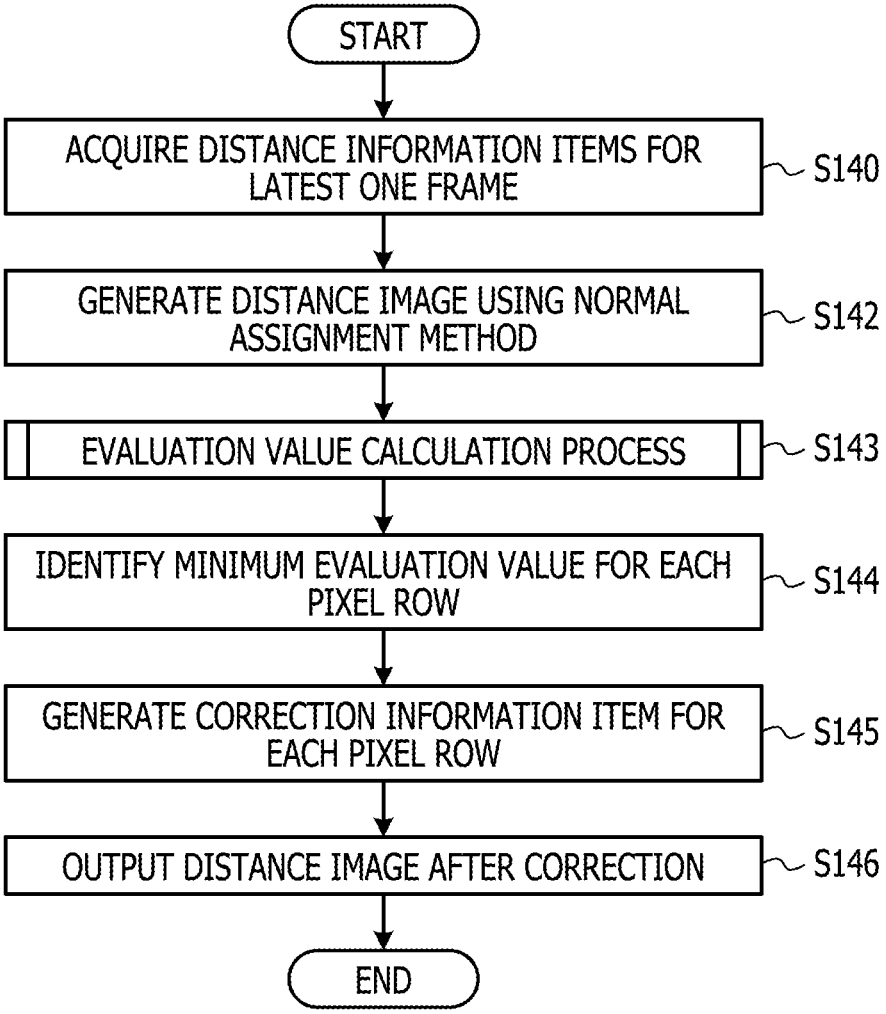
FIG. 14 is a flowchart of a process to be executed by the image information output apparatus in a first operational example.

FIG. 14 is a flowchart of a process to be executed by the image information output apparatus 100 in a first operational example. The process illustrated in FIG. 14 may be repeatedly executed every time distance information items for one frame are generated by the distance measuring apparatus 10. The case where the image information output apparatus 100 operates in real time during an operation of the distance measuring apparatus 10 is described below. The image information output apparatus 100, however, may operate offline based on distance information items previously generated by the distance measuring apparatus 10.

In step S140, the distance information item acquirer 150 of the image information output apparatus 100 acquires distance information items for the latest one frame.

In step S142, the evaluation value calculator 151 of the image information output apparatus 100 generates a distance image (one frame) using the normal assignment method based on the distance information items, acquired in step S140, for the one frame. The normal assignment method is described above (refer to FIGS. 8, 13, and the like).

In step S143, the evaluation calculator 151 executes an evaluation value calculation process to calculate the aforementioned evaluation values based on the distance image generated in step S142. An example of the evaluation value calculation process is described later with reference to FIG. 16 (i.e., FIGS. 16A and 16B). In FIG. 14, the evaluation values, each of which becomes smallest when there is not a "deviation in an adjacency relationship between pixel value information items" within a pixel row, are used as an example.

FIG. 15 is a table diagram illustrating results of calculating evaluation values obtained for a certain single frame. As illustrated in FIG. 15, in step S143, evaluation values are calculated for each of pixel rows extending in the horizontal direction in the distance image for the single frame for each of the multiple assignment methods. In FIG. 15, a1 to a9 indicate results of calculating evaluation values. In the example illustrated in FIG. 15, in a first assignment method (the shifting number M described later is −k) for a first pixel row, the result of calculating an evaluation value indicates "a1".

In step S144, the correction information item generator 152 of the image information output apparatus 100 identifies the smallest evaluation value for each of pixel rows based on the results of calculating the evaluation values in step S144. In the example illustrated in FIG. 15, results of calculating evaluation values are "a1", "a2", . . . , and "a3" for the first pixel row, and the smallest evaluation value among the calculated evaluation values for the first pixel row is identified.

In step S145, the correction information item generator 152 generates a correction information item for each of the pixel rows based on the smallest evaluation values identified in step S144. In FIG. 14, each of the correction information items is information from which an assignment method for which the smallest evaluation value is calculated is identified, and each of the correction information items indicates the shifting number M (described later) causing the smallest evaluation value.

In step S146, the correction information item generator 152 corrects the distance image generated in step S142 based on the correction information items generated in step S148 and related to all the pixel rows for the single frame. Specifically, the correction information item generator 152 corrects, based on the correction information items, each of pixel rows for which correction information items that do not indicate that the shifting number M is 0 have been generated. Then, the correction information item generator 152 outputs the distance image (another form of the correction information items) after the correction. The distance image after the correction is obtained as a result of executing the assignment using an assignment method for which the smallest evaluation values have been calculated.

In the process illustrated in FIG. 14, step S146 may be executed at different time or executed by another device. In the process illustrated in FIG. 14, the evaluation value calculator 151 generates the distance image using the normal assignment method in step S142, but step S142 is not limited to this. In step S142, the evaluation value calculator 151 may generate a distance image using one of the aforementioned correction assignment methods. This is due to the fact that the distance image generated in step S142 is finally corrected in step S146.

Figure 16A:
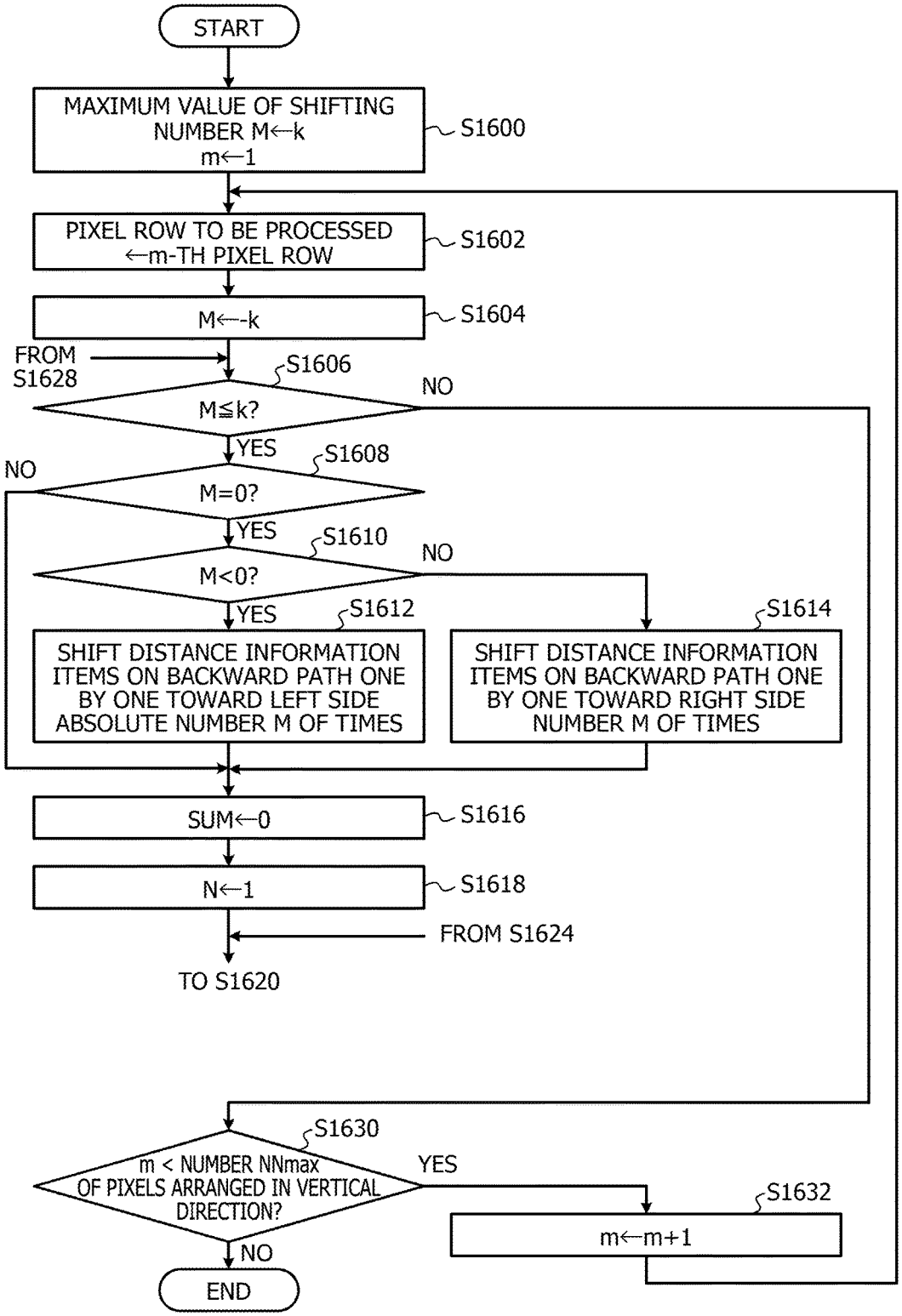
FIGS. 16A and 16B are flowcharts of an example of an evaluation value calculation process.
Figure 16B:
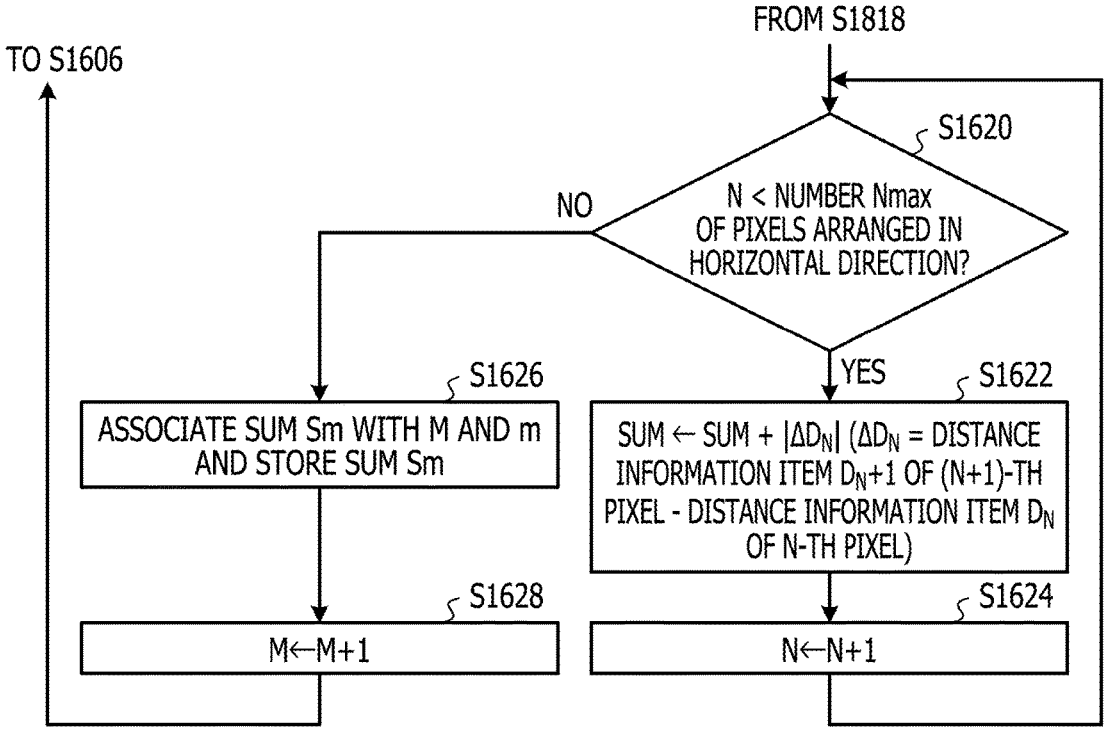

FIG. 16 (i.e., FIGS. 16A and 16B) is a flowchart of an example of the evaluation value calculation process to be executed in step S143.

In step S1600, the evaluation value calculator 151 sets the maximum value of the shifting number M to the maximum number "k" and sets a row number m of a "pixel row to be processed" to "1". The shifting number M is the number of times that pixels to which distance information items on a backward path are assigned are shifted one by one toward the left or right side in the horizontal direction in the distance image generated in step S142. If the shifting number M is 0, the normal assignment method is used. If the shifting number M is equal to or larger than 1, any of the correction assignment methods is used. The maximum number "k" is an arbitrary integer of 1 or more and may be changed by a user. In FIG. 16, the maximum number "k" may be 2, for example.

In step S1602, the evaluation value calculator 151 extracts, from the distance image generated in step S142, an m-th pixel row (pixel row extending in the horizontal direction) as a "pixel row to be processed". For example, the evaluation value calculator 151 may extract the m-th pixel row from the top of the distance image in the vertical direction.

In step S1604, the evaluation value calculator 151 sets the shifting number M to an initial value "−k". Specifically, M=−k.

In step S1606, the evaluation value calculator 151 determines whether or not the shifting number M is equal to or smaller than the maximum number k. If the shifting number M is equal to or smaller than the maximum number k, the process proceeds to step S1608. If the shifting number M is larger than the maximum number k, the process proceeds to step S1630.

In step S1608, the evaluation value calculator 151 determines whether or not the shifting number M is 0. If the shifting number M is 0, the process proceeds to step S1616. If the shifting number M is not 0, the process proceeds to step S1610.

In step S1610, the evaluation value calculator 151 determines whether or not the shifting number M is negative. If the shifting number M is negative, the process proceeds to step S1612. If the shifting number M is not negative (or is positive), the process proceeds to step S1614.

In step S1612, the evaluation value calculator 151 shifts the distance information items on the backward path one by one toward the left side the absolute number M of times in the distance image generated in step S142. For example, if M=−1, the shifting corresponds to the correction assignment method (No. 1) illustrated in FIG. 13. If M=−2, the shifting corresponds to the correction assignment method (No. 3) illustrated in FIG. 13.

In step S1614, the evaluation value calculator 151 shifts the distance information items on the backward path one by one toward the right side the number M of times in the distance image generated in step S142. For example, if M=1, the shifting corresponds to the correction assignment method (No. 2) illustrated in FIG. 13.

In step S1616, the evaluation value calculator 151 sets a sum to an initial value "0". The sum finally becomes an evaluation value, as described later.

In step S1618, the evaluation value calculator 151 sets N to "1".

In step S1620, the evaluation value calculator 151 determines whether or not N is smaller than a number Nmax of pixels arranged in the horizontal direction in the distance image. The number Nmax of pixels arranged in the horizontal direction in the distance image is a defined value. If N is smaller than the number Nmax of pixels arranged in the horizontal direction in the distance image, the process proceeds to step S1622. If N is not smaller than the number Nmax, the process proceeds to step S1626.

In step S1622, the evaluation value calculator 151 calculates the absolute value $|\Delta D_N|$ of the difference $\Delta D_N$ ($=D_{N+1}-D_N$) between a distance information item $D_N$ of an N-th pixel from the leftmost side of the distance image and a distance information item $D_{N+1}$ of an (N+1)-th pixel from the leftmost side of the distance image. Then, the evaluation value calculator 151 updates the sum by adding the calculated absolute value $|\Delta D_N|$ to the sum.

In step S1624, the evaluation value calculator 151 increments N by only "1" and repeats the process from step S1620. As a result, the sum Sm is finally expressed by the following Equation (1).

$$Sm = \sum_{i=1}^{N_{max}-1} (|D_{N+1} - D_N|) \tag{1}$$

In step S1626, the evaluation value calculator 151 associates the final sum Sm with the shifting number M and the row number m indicating the currently set pixel row to be processed and stores the final sum Sm. The sum Sm stored in step S1626 is an evaluation value for the m-th pixel row for an assignment method related to the shifting number M.

In step S1628, the evaluation value calculator 151 increments the shifting number M by only "1".

In step S1630, the evaluation value calculator 151 determines whether or not the row number m is smaller than a number NNMax of pixels arranged in the vertical direction in the distance image. The number NNMax of pixels arranged in the vertical direction in the distance image is a defined value. If the row number m is smaller than the number NNMax of pixels arranged in the vertical direction in the distance image, the process proceeds to step S1632 and returns to step S1602. If the row number m is not smaller than the number NNMax, the evaluation value calculator 151 determines that an unprocessed pixel row does not exist, and the evaluation value calculator 151 terminates the process.

In step S1632, the evaluation value calculator 151 increments the row number m by only "1".

According to the first operational example, the sum is calculated according to Equation (1) as an evaluation value related to a "deviation in an adjacency relationship between pixel value information items" within a pixel row. Specifically, if distance information items of each pair of adjacent pixels within a pixel row to be processed are treated as a single pair, the evaluation value calculator 151 calculates, as an evaluation value, the sum of absolute values of differences between all pairs of distance information items. Then, the evaluation value calculator 151 calculates evaluation values for the pixel rows while changing the shifting number M. Thus, a number k of evaluation values in the case where the shifting number M is positive, a number k of evaluation values in the case where the shifting number M is negative, and a single evaluation value in the case where the shifting number M is 0, are obtained for each of the pixel rows, or a number 2k+1 of evaluation values are obtained for each of the pixel rows.

According to the first operational example, the evaluation values are calculated, while attention is paid to the fact that, if a deviation in an adjacency relationship between pixel value information items occurs in the distance image, the number of image portions in which differences between distance information items of pixels adjacent to each other in the horizontal direction are large is large. Specifically, the sum of absolute values of differences between distance information items of target pixels and distance information items of pixels adjacent to the target pixels is calculated as an evaluation value, while the number of times that the distance information items on the backward path are shifted one by one toward the left or right side is changed.

According to the first operational example, for each of the pixel rows, the shifting number M that does not cause a "deviation in an adjacency relationship between pixel value information items" may be accurately identified based on evaluation values for shifting numbers, and a highly accurate correction information item may be obtained.

Figure 17A:
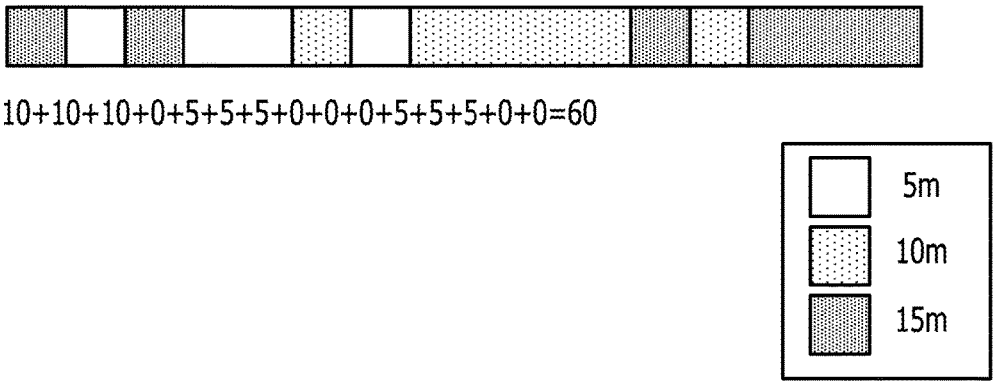
FIG. 17A is a diagram describing an evaluation value in the case where a shifting number M is 0 in the first operational example.
Figure 17B:
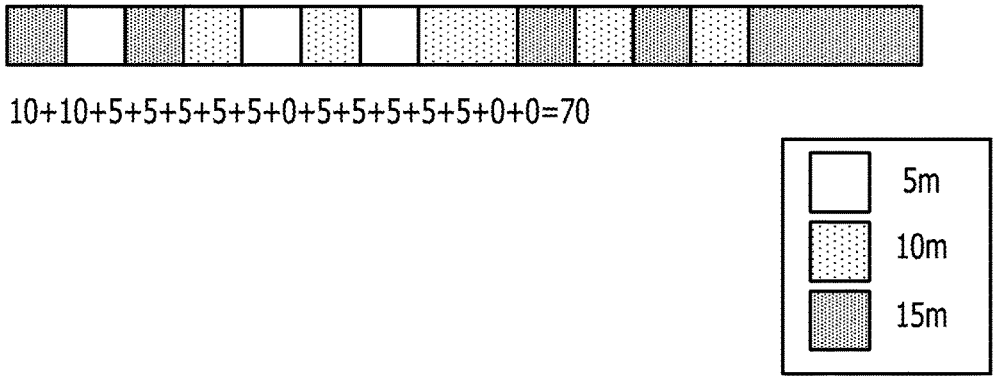
FIG. 17B is a diagram describing an evaluation value in the case where the shifting number M is −1 in the first operational example.
Figure 17C:
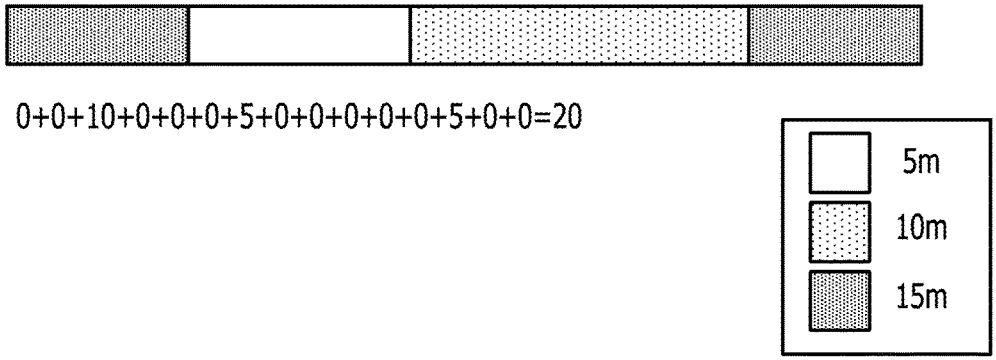
FIG. 17C is a diagram describing an evaluation value in the case where the shifting number M is 1 in the first operational example.

FIGS. 17A to 17C and 18 are diagrams describing effects of the first operational example. FIGS. 17A to 17C describe effects of the correction information items obtained in the first operational example on the distance image illustrated in FIG. 10 and obtained using the normal assignment method when there are the deviations in the adjacency relationships between the sampling horizontal angles illustrated in FIG. 9 in the state illustrated in FIG. 7.

FIG. 17A is a diagram related to a distance image in the case where the shifting number M is 0. FIG. 17A schematically illustrates distance information items on a certain pixel row and a sum Sm for the certain pixel row. In the case where the shifting number M is 0, the shifting corresponds to the normal assignment method. Thus, the pixel row of the distance image illustrated in FIG. 17A corresponds to a single pixel row of the distance image illustrated in FIG. 10. In this case, as illustrated in FIG. 17A, the sum Sm=10+10+10+0+5+5+5+0+0+0+5+5+5+0+0=60.

FIG. 17B is a diagram related to a distance image in the case where the shifting number M is −1. FIG. 17B schematically illustrates distance information items on a certain pixel row and a sum Sm for the certain pixel row. In the case where the shifting number M is −1, the shifting corresponds to the correction assignment method (No. 1) illustrated in FIG. 13. In this case, as illustrated in FIG. 17B, the sum Sm=10+10+5+5+5+5+5+0+5+5+5+5+5+0+0=70.

FIG. 17C is a diagram related to a distance image in the case where the shifting number M is 1. FIG. 17C schematically illustrates distance information items on a certain pixel row and a sum Sm for the certain pixel row. In the case where the shifting number M is 1, the shifting corresponds to the correction assignment method (No. 2) illustrated in FIG. 13. In this case, as illustrated in FIG. 17C, the sum Sm=0+0+10+0+0+0+5+0+0+0+0+0+5+0+0=20. Although not illustrated, in the case where the shifting number M is 2 or −2, the sum Sm is not smaller than 20.

Figure 18:
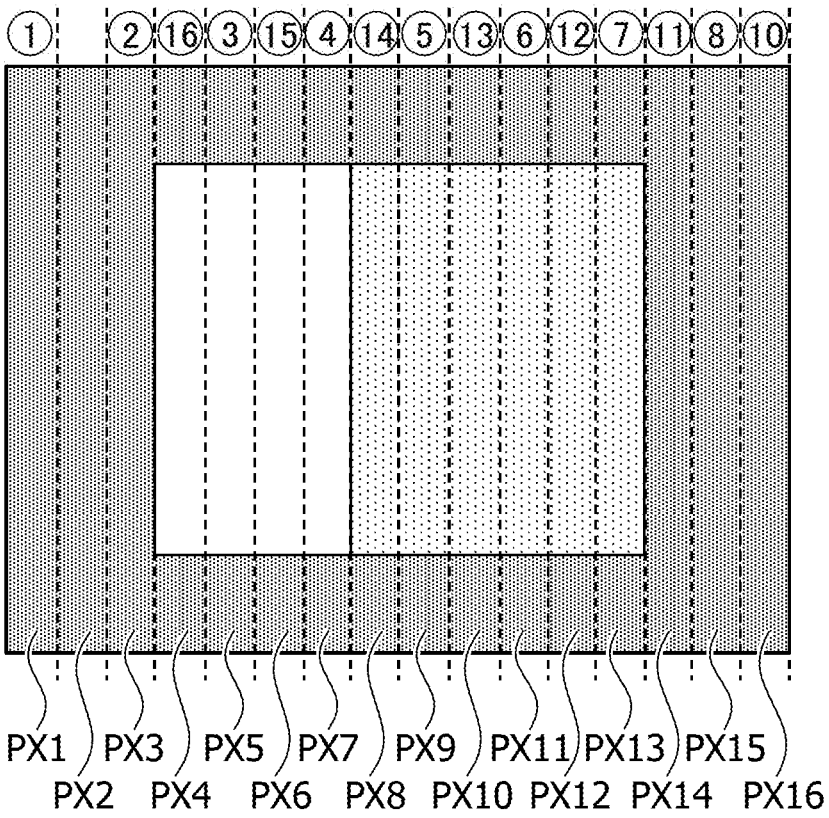
FIG. 18 is a diagram describing a distance image corrected based on correction information items.

In the example illustrated in FIGS. 17A to 17C, since the smallest sum Sm is 20, the correction information item generator 152 generates a correction information item based on the sum Sm that is equal to 20. For example, since the sum Sm is 20 in the case where the shifting number M is 1, the correction information item generator 152 generates the correction information item indicating that the shifting number M is 1. In this case, a distance image illustrated in FIG. 18 is obtained by correcting the distance image (distance image generated using the normal assignment method) illustrated in FIG. 10 based on the shifting number M equal to 1. FIG. 18 illustrates the distance image obtained by correcting, based on the correction information item, the distance image obtained using the normal assignment method when there are the deviations in the adjacency relationships between the sampling horizontal angles illustrated in FIG. 9 in the state illustrated in FIG. 7. As is apparent from the comparison of FIG. 10 with FIG. 18, the deviations in the adjacency relationships between the pixel value information items in the distance image illustrated in FIG. 10 do not occur in the distance image illustrated in FIG. 18. This indicates that the deviations, caused in the normal assignment method, in the adjacency relationships between the pixel value information items are appropriately corrected. According to the first operational example, a deviation, caused in the normal assignment method, in an adjacency relationship between pixel value information items within a pixel row may be appropriately corrected, and as a result, a distance image that does not have a deviation in an adjacency relationship between pixel value information items may be obtained.

In the aforementioned first operational example, the evaluation value calculator 151 sets N to "1" in step S1618 and determines whether or not N is smaller than the number Nmax of pixels arranged in the horizontal direction in the distance image in step S1620 in the process illustrated in FIG. 16. Steps 1618 and 1620, however, are not limited to this. For example, the evaluation value calculator 151 may set N to a predetermined value Np1 in step S1618 and determine whether or not N is smaller than a value obtained by subtracting a predetermined value Np2 from the number Nmax of pixels arranged in the horizontal direction in the distance image. The predetermined values Np1 and Np2 are arbitrary. For example, the predetermined values Np1 and Np2 may be changed based on the shifting number M in such a manner that evaluation values are calculated for only a range in which distance information items on the forward path and distance information items on the backward path are alternately arranged. For example, if the shifting number M is negative, the predetermined value Np1 may be equal to 1, and the predetermined value Np2 may be equal to −2M−1. In addition, if the shifting number M is positive, the predetermined value Np1 may be equal to 2M+1, and the predetermined value Np2 may be equal to 0. The same applies second and third operational examples described later.

In the first operational example, the evaluation value calculator 151 calculates sums Sm based on Equation (1) as the evaluation values, but is not limited to this. For example, the evaluation value calculator 151 may calculate, as each of the evaluation values, the number of image portions in which differences $\Delta D_N$ are equal to or larger than a predetermined value Dth. The predetermined value Dth may be determined based on differences between distance information items of pixels adjacent to each other in the horizontal direction if a deviation in an adjacent relationship between pixel value information items occurs.

In the first operational example, a number k of evaluation values in the case where the shifting number M is positive and a number k of evaluation values in the case where the shifting number M is negative are calculated for each pixel row, but the evaluation values are not limited to this. For example, a number k of evaluation values in the case where the shifting number M is positive or negative may be calculated for each pixel row. The same applies the second and third operational examples described below.

Second Operational Example

The second operational example is different from the first operational example only in terms of an evaluation value calculation process to be executed in step S144. The evaluation value calculation process to be executed in the second operational example is described below.

Figure 19A:
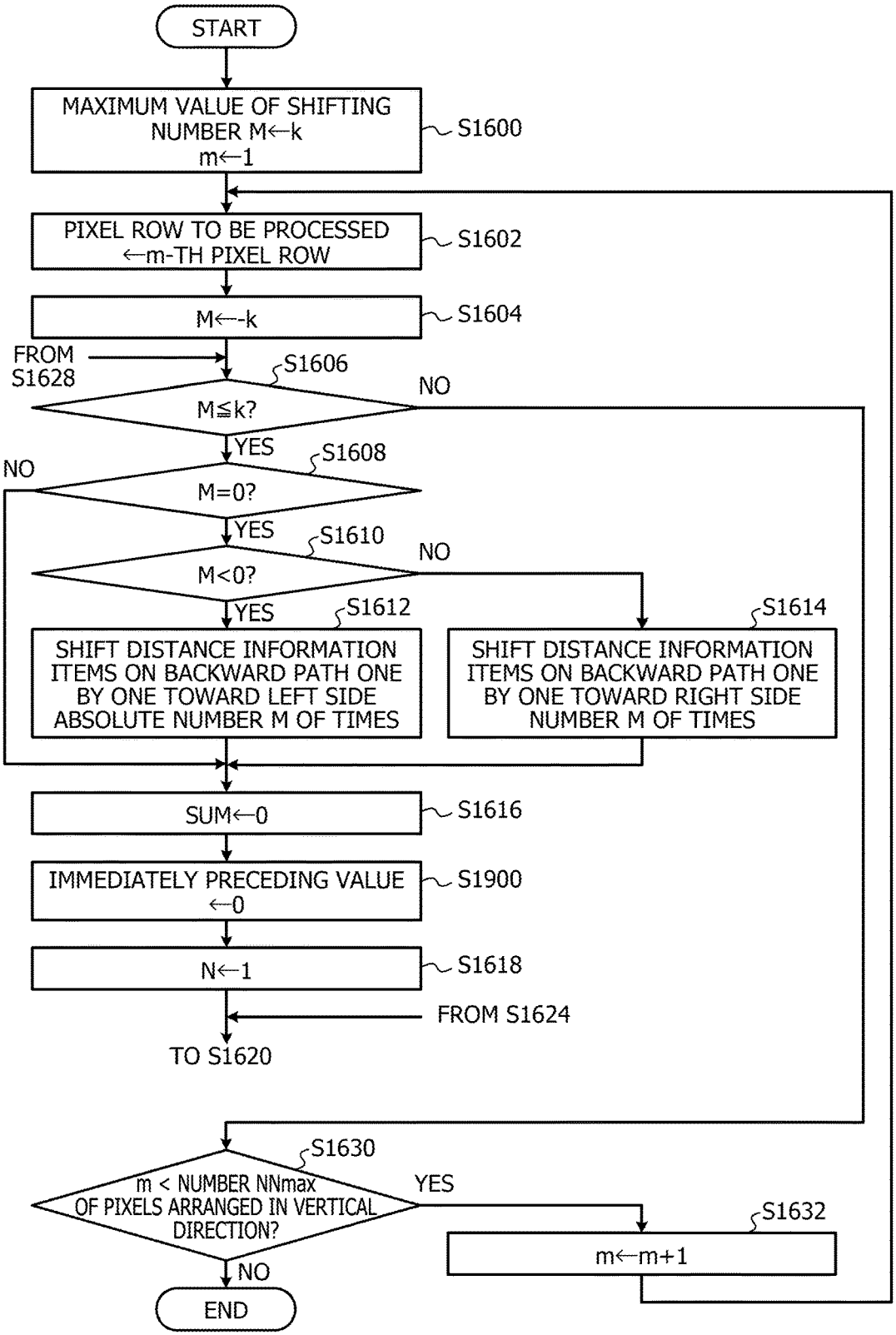
FIGS. 19A and 19B are flowcharts of an example of an evaluation value calculation process to be executed in step S144 in a second operational example.
Figure 19B:
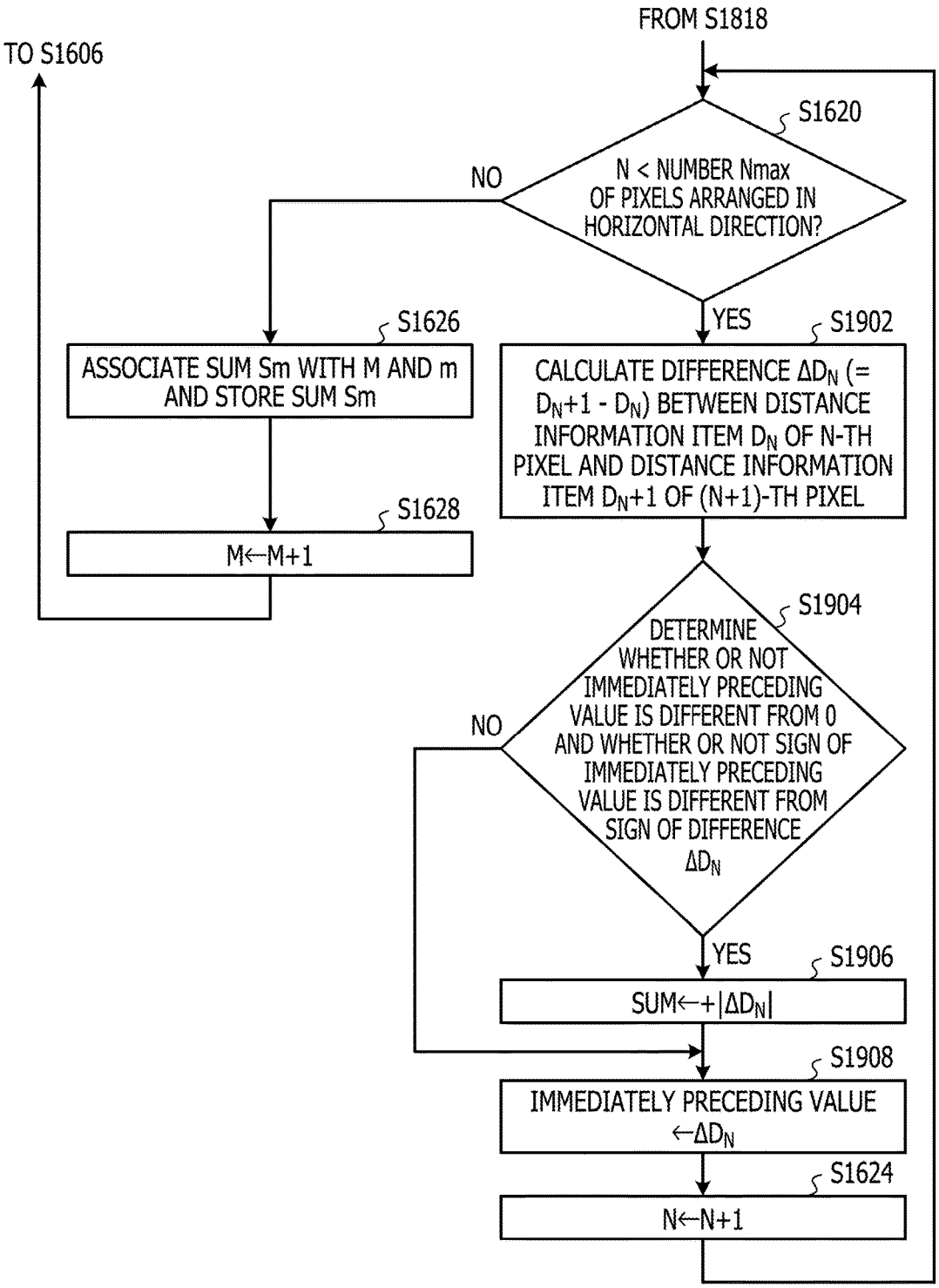

FIG. 19 (i.e., FIGS. 19A and 19B) is a flowchart of an example of the evaluation value calculation process to be executed in step S144 in the second operational example.

Steps that are included in the process illustrated in FIG. 19 and are the same as those included in the process illustrated in FIG. 16 are indicated by the same step numbers as those illustrated in FIG. 16, and a description thereof is omitted. The process illustrated in FIG. 19 is different from the process illustrated in FIG. 16 in that step S1900 is added between steps S1616 and S1618 in the process illustrated in FIG. 19 and that steps S1902 to S1908 are set instead of step S1622 in the process illustrated in FIG. 19. Step S1900 may be executed between steps S1618 and S1620 or between other steps.

In step S1900, the evaluation value calculator 151 sets an immediately preceding value to "0".

In step S1902, the evaluation value calculator 151 calculates the difference $\Delta D_N$ ($=D_{N+1}-D_N$) between a distance information item $D_N$ of an N-th pixel from the leftmost side of the distance image and a distance information item $D_{N+1}$ of an (N+1)-th pixel from the leftmost side of the distance image.

In step S1904, the evaluation value calculator 151 determines whether or not the immediately preceding value is different from 0 and whether or not the sign of the immediately preceding value is different from the sign of the difference $\Delta D_N$ calculated in step S1902. For example, if the immediately preceding value is negative and the sign of the difference $\Delta D_N$ calculated in step S1902 is positive, the result of the determination indicates "YES". If the immediately preceding value is positive and the sign of the difference $\Delta D_N$ calculated in step S1902 is negative, the result of the determination indicates "YES". On the other hand, if the immediately preceding value is 0 or the difference $\Delta D_N$ calculated in step S1902 is 0, the result of the determination indicates "NO". If the immediately preceding value is not 0, the difference $\Delta D_N$ calculated in step S1902 is not 0, and the immediately preceding value and the difference $\Delta D_N$ are both positive or both negative, the result of the determination indicates "NO". If the result of the determination indicates "YES", the process proceeds to step S1906. If the result of the determination indicates "NO", the process proceeds to step S1908.

In step S1906, the evaluation value calculator 151 updates a sum by adding the absolute value $|\Delta D_N|$ of the difference $\Delta D_N$ calculated in step S1902 to the sum.

In step S1908, the evaluation value calculator 151 sets (updates) the immediately preceding value to the difference $\Delta D_N$ calculated in step S1902. The immediately preceding value is equal to the difference $\Delta D_N$.

The process proceeds to steps S1908 and S1624 and is repeated from step S1620. As a result, in the second operational example, the sum Sm is finally expressed according to the following Equation (2).

$$Sm = \sum_{i=1}^{N_{max}-1} (|C_{N+1} - C_N|) \tag{2}$$

In Equation (2), if N is equal to or larger than 2, and the following requirement is satisfied, $|C_{N+1}-C_N|=|D_{N+1}-D_N|$.

The requirement is that $(D_{N+1}-D_N)\times(D_N-D_{N-1})<0$.

If this requirement is not satisfied or if N=1, $|C_{N+1}-C_N|=0$ in Equation (2).

According to the second operational example, as an evaluation value related to a "deviation in an adjacency relationship between pixel value information items" within a pixel row, the sum is calculated according to Equation (2). Specifically, if distance information items of each pair of adjacent pixels within a pixel row to be processed are treated as a single pair, the evaluation value calculator 151 calculates, as each of the evaluation values, the sum of absolute values of differences between pairs of distance information items of image portions in which the sign of the difference between a pair of distance information items of N-th and (N+1)-th pixels adjacent to each other is different from the sign of the difference between a pair of distance information items of (N+1)-th and (N+2)-th pixels adjacent to each other. Then, the evaluation value calculator 151 calculates evaluation values for each of the pixel rows while changing the shifting number M. Thus, a number k of evaluation values in the case where the shifting number M is positive, a number k of evaluation values in the case where the shifting number M is negative, and a single evaluation value in the case where the shifting number M is 0, are obtained for each of the pixel rows, or a number 2k+1 of evaluation values are obtained for each of the pixel rows.

If a deviation in an adjacency relationship between pixel value information items occurs in the distance image, the number of image portions in which the sign of the difference $\Delta D_N$ between an N-th pixel and an (N+1)-th pixel adjacent to the N-th pixel on the right side is different from the sign of the difference $\Delta D_{N+1}$ between the (N+1)-th pixel and an (N+2)-th pixel adjacent to the (N+1)-th pixel is large. According to the second operational example, while this fact is paid attention, the evaluation values are calculated by summing absolute values of differences between pairs of distance information items of image portions in which the sign of the difference between a pair of distance information items of N-th and (N+1)-th pixels adjacent to each other is different from the sign of the difference between a pair of distance information items of (N+1)-th and (N+2)-th pixels adjacent to each other.

According to the second operational example, for each of the pixel rows, the shifting number M that does not cause a "deviation in an adjacency relationship between pixel value information items" may be accurately identified based on evaluation values related to the different shifting numbers, and a highly accurate correction information item may be obtained.

Figure 20A:
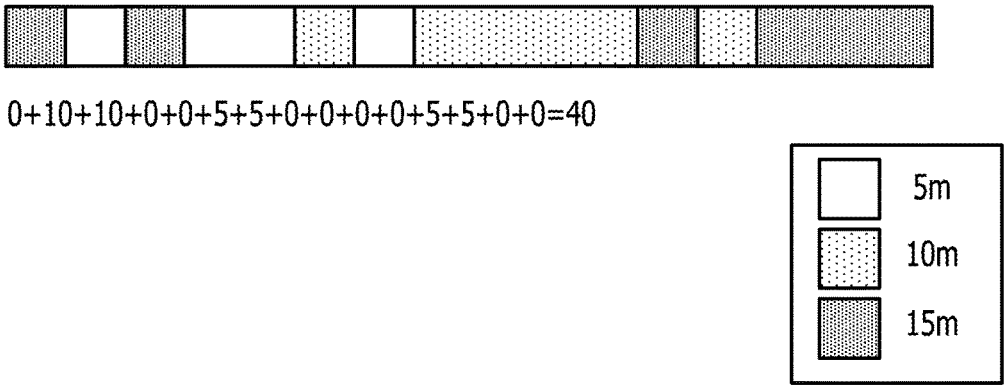
FIG. 20A is a diagram describing an evaluation value in the case where the shifting number M is 0 in the second operational example.
Figure 20B:
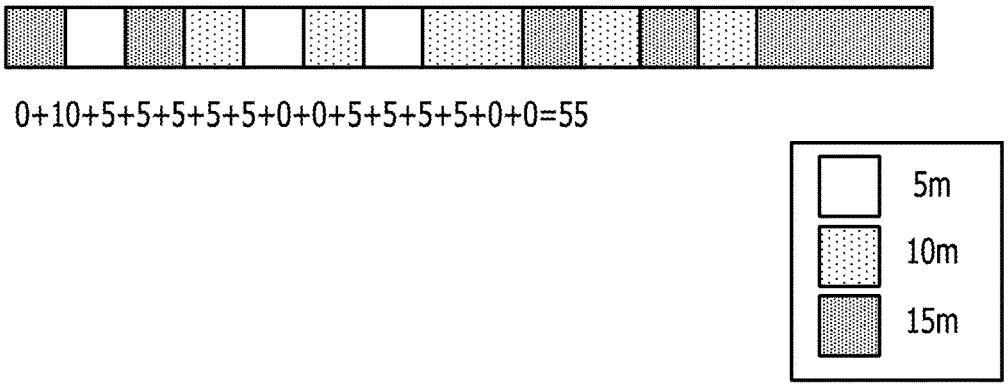
FIG. 20B is a diagram describing an evaluation value in the case where the shifting number M is −1 in the second operational example.
Figure 20C:
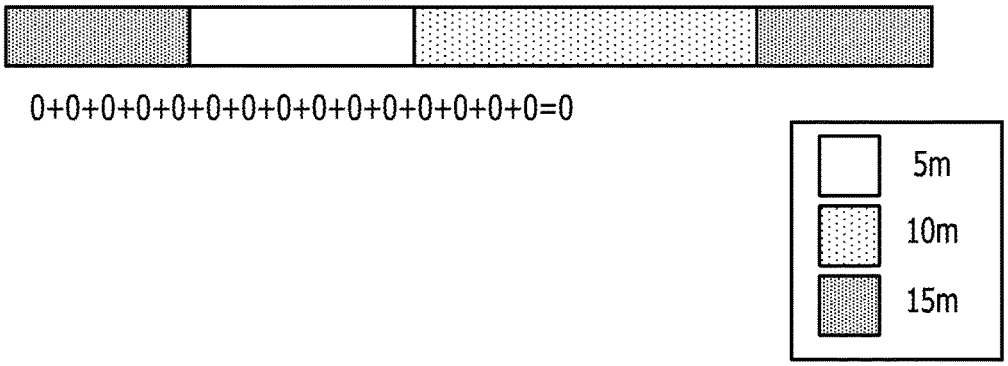
FIG. 20C is a diagram describing an evaluation value in the case where the shifting number M is 1 in the second operational example.

FIGS. 20A to 20C are diagrams describing effects of the second operational example. FIGS. 20A to 20C describe effects of correction information items obtained in the second operational example on the distance image illustrated in FIG. 10 and obtained using the normal assignment method in the case where there are the deviations in the adjacency relationships between the sampling horizontal angles illustrated in FIG. 9 in the state illustrated in FIG. 7.

FIG. 20A is a diagram related to a distance image in the case where the shifting number M is 0. FIG. 20A schematically illustrates distance information items on a certain pixel row and a sum Sm for the certain pixel row. In the case where the shifting number M is 0, the shifting corresponds to the normal assignment method, and the pixel row of the distance image illustrated in FIG. 20A corresponds to a single pixel row of the distance image illustrated in FIG. 10. In this case, as illustrated in FIG. 20A, the sum Sm=0+10+10+0+0+5+5+0+0+0+0+5+5+0+0=40.

FIG. 20B is a diagram related to a distance image in the case where the shifting number M is −1. FIG. 20B schematically illustrates distance information items on a certain pixel row and a sum Sm for the certain pixel row. In the case where the shifting number M is −1, the shifting corresponds to the correction assignment method (No. 1) illustrated in FIG. 13. In this case, as illustrated in FIG. 20B, the sum Sm=0+10+5+5+5+5+5+0+0+5+5+5+5+0+0=55.

FIG. 20C is a diagram related to a distance image in the case where the shifting number M is 1. FIG. 20C schematically illustrates distance information items on a certain pixel row and a sum Sm for the certain pixel row. In the case where the shifting number M is 1, the shifting corresponds to the correction assignment method (No. 2) illustrated in FIG. 13. In this case, as illustrated in FIG. 20C, the sum Sm=0+0+0+0+0+0+0+0+0+0+0+0+0+0+0=0. Although not illustrated, in the case where the shifting number M is 2 or −2, the sum Sm is not 0.

Thus, in the example illustrated in FIGS. 20A to 20C, since the smallest sum Sm is 0, the correction information item generator 152 generates a correction information item based on the sum Sm that is equal to 0. For example, since the sum Sm is 0 in the case where the shifting number M is 1, the correction information item generator 152 generates the correction information item indicating that the shifting number M is 1. In this case, the distance image illustrated in FIG. 18 is obtained by correcting the distance image (distance image generated using the normal assignment method) illustrated in FIG. 10 based on the shifting number M equal to 1. According to the second operational example, a deviation, caused in the normal assignment method, in an adjacency relationship between pixel value information items within a pixel row may be appropriately corrected, and as a result, a distance image that does not have a deviation in an adjacency relationship between pixel value information items may be obtained, like the aforementioned first operational example.

In the second operational example, in FIG. 19, the evaluation value calculator 151 updates the sum by adding the absolute value $|\Delta D_N|$ of the difference $\Delta D_N$ calculated in step S1902 to the sum in step S1906, but step S1906 is not limited to this. For example, in step S1906, the evaluation value calculator 151 may update the sum by adding the immediately preceding value to the sum, instead of the absolute value $|\Delta D_N|$ of the difference $\Delta D_N$ calculated in step S1902. The same applies the third operational example.

In the second operational example, the evaluation value calculator 151 calculates sums Sm based on Equation (2) as the evaluation values, but is not limited to this. For example, the evaluation value calculator 151 may calculate, as each of the evaluation values, the number of image portions in which the sign of the difference $\Delta D_N$ between an N-th pixel and an (N+1)-th pixel adjacent to the N-th pixel on the right side is different from the sign of the difference $\Delta D_{N+1}$ between the (N+1)-th pixel and an (N+2)-th pixel adjacent to the (N+1)-th pixel on the right side.

Third Operational Example

The third operational example is different from the first operational example only in terms of an evaluation value calculation process to be executed in step S144. The evaluation value calculation process to be executed in the third operational example is described below.

Figure 21A:
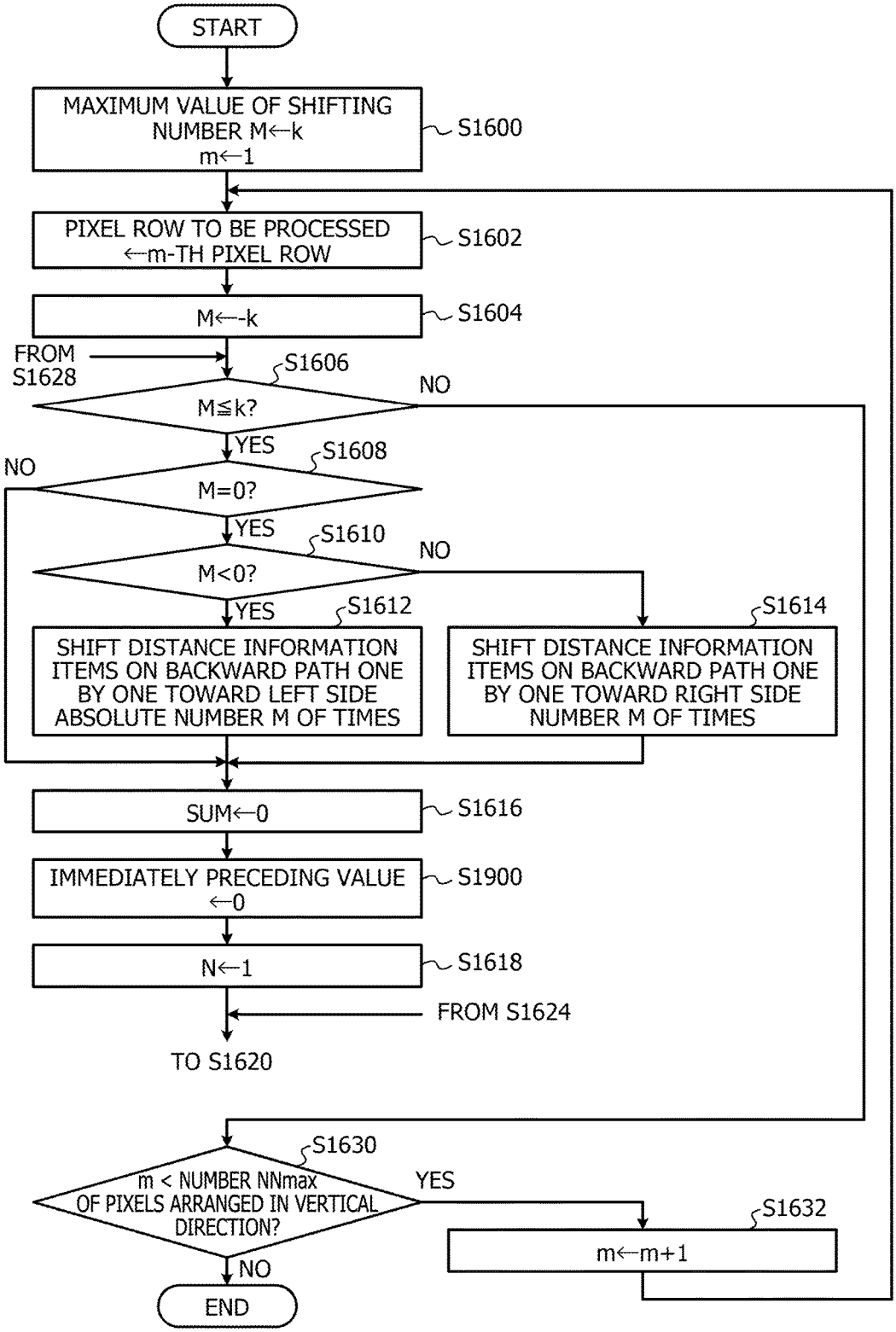
FIGS. 21A and 21B are flowcharts of an example of an evaluation value calculation process to be executed in step S144 in a third operational example.
Figure 21B:
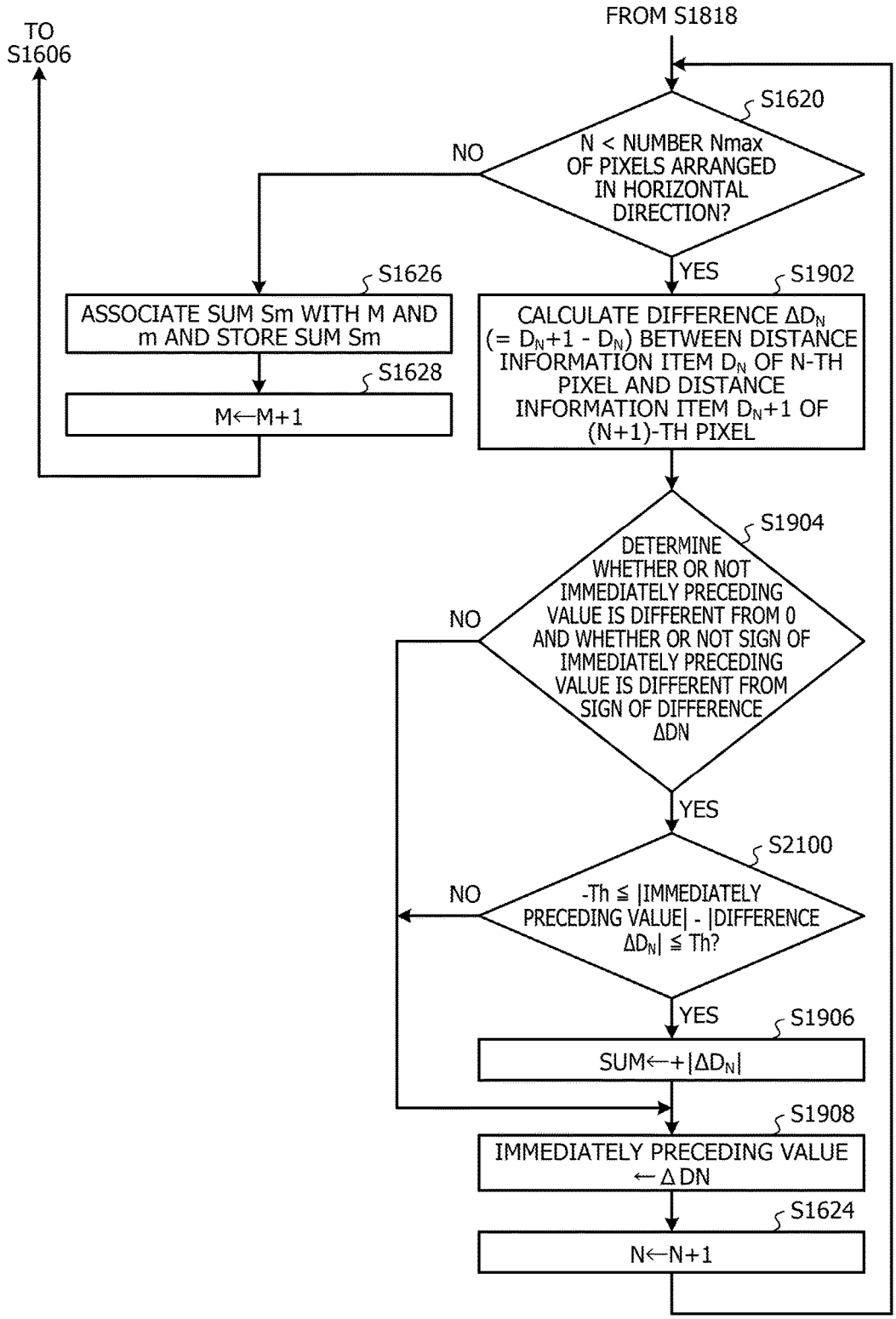

FIG. 21 (i.e., FIGS. 21A and 21B) is a flowchart of an example of the evaluation value calculation process to be executed instep S144 in the third operational example.

Steps that are included in the process illustrated in FIG. 21 and are the same as those included in the process illustrated in FIG. 19 and related to the second operational example are indicated by the same step numbers as those illustrated in FIG. 19, and a description thereof is omitted. The process illustrated in FIG. 21 is different from the process illustrated in FIG. 19 in that step S2100 is added between step S1904 and S1906 in the process illustrated in FIG. 21.

Step S2100 is executed if the result of the determination of step S1904 indicates "YES".

In step S2100, the evaluation value calculator 151 determines whether or not the absolute value of the difference between the absolute value of the immediately preceding value and the absolute value of the difference $\Delta D_N$ calculated in step S1902 is equal to or smaller than a predetermined threshold Th. The predetermined threshold Th is used to determine whether or not the absolute value of the difference $\Delta D_N$ is close to the absolute value of the immediately preceding value. The predetermined threshold Th is an adaptive value. For example, the predetermined threshold Th is set based on a range of the difference between distance information items obtained at two adjacent sampling horizontal angles for the same object. If the result of the determination indicates "YES", the process proceeds to step S1906. If the result of the determination indicates "NO", the process proceeds to step S1908.

The process proceeds to steps S1908 and S1624 and is repeated from step S1620. As a result, in the third operational example, the sum Sm is finally expressed according to the following Equation (3).

$$Sm = \sum_{i=1}^{N_{max}-1} (|C_{N+1} - C_N|) \tag{3}$$

In Equation (3), if N is equal to or larger than 2, and the following requirement is satisfied, $|C_{N+1}-C_N|=|D_{N+1}-D_N|$.

The requirement is that $(D_{N+1}-D_N)\times(D_N-D_{N-1})<0$ and $-Th\leq|D_{N+1}-D_N|-|D_N-D_{N-1}|\leq Th$.

If this requirement is not satisfied or if N=1, $|C_{N+1}-C_N|=0$ in Equation (3).

According to the third operational example, as an evaluation value related to a "deviation in an adjacency relationship between pixel value information items" within a pixel row, the sum Sm is calculated according to Equation (3). Specifically, if distance information items on each pair of adjacent pixels within a pixel row to be processed is treated as a pair, the evaluation value calculator 151 calculates, as each of the evaluation values, the sum of absolute values of differences between distance information items of image portions in which the sign of the difference between a pair of distance information items of N-th and (N+1) adjacent to each other pixels is different from the sign of the difference between a pair of distance information items of (N+1) and (N+2) pixels adjacent to each other and in which the absolute value of the difference between the pair of distance information items of the N-th and (N+1) pixels is close to the absolute value of the difference between the pair of distance information items of the (N+1) and (N+2) pixels. Then, the evaluation value calculator 151 calculates evaluation values for each of the pixel rows while changing the shifting number M. Thus, a number k of evaluation values in the case where the shifting number M is positive, a number k of evaluation values in the case where the shifting number M is negative, and an evaluation value in the case where the shifting number M is 0, are obtained for each of the pixel rows, or a number 2k+1 of evaluation values are obtained for each of the pixel rows.

If a deviation in an adjacency relationship between pixel value information items occurs in the distance image, the number of image portions in which the sign of the difference $\Delta D_N$ between an N-th pixel and an (N+1)-th pixel adjacent to the N-th pixel on the right side is different from the sign of the difference $\Delta D_{N+1}$ between the (N+1)-th pixel and an (N+2)-th pixel adjacent to the (N+1)-th pixel on the right side and in which the absolute value of the difference between $\Delta D_N$ is close to the absolute value of the difference between $\Delta D_{N+1}$ is large. According to the third operational example, while this fact is paid attention, the evaluation values are calculated by summing only absolute values of differences between pairs of distance information items of image portions in which the sign of the difference between a pair of distance information items of N-th and (N+1)-th pixels adjacent to each other is different from the sign of the difference between a pair of distance information items of (N+1)-th and (N+2)-th pixels adjacent to each other and in which the absolute value of the differences between the pair of distance information items of the N-th and (N+1)-th pixels is close to the pair of distance information items of the (N+1)-th and (N+2)-th pixels.

According to the third operational example, for each of the pixel rows, the shifting number M that does not cause a "deviation in an adjacency relationship between pixel value information items" may be accurately identified based on evaluation values for the different shifting numbers, and a highly accurate correction information item may be obtained.

Figure 22A:
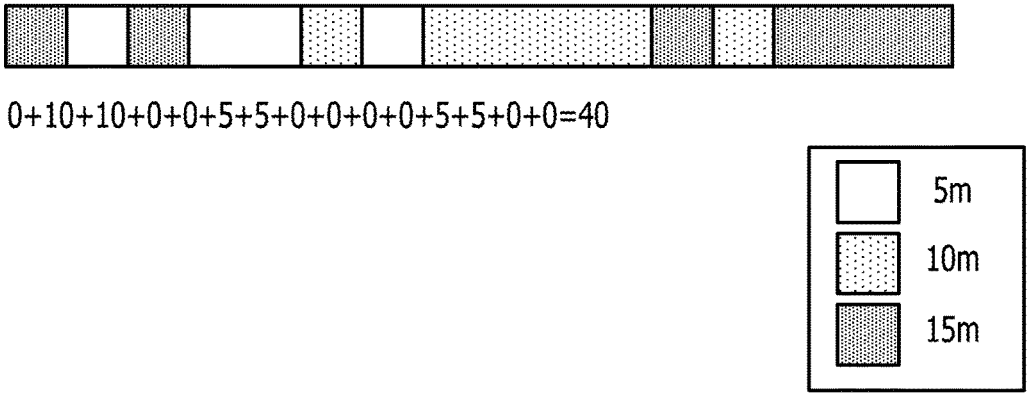
FIG. 22A is a diagram describing an evaluation value in the case where the shifting number M is 0 in the third operational example.
Figure 22B:
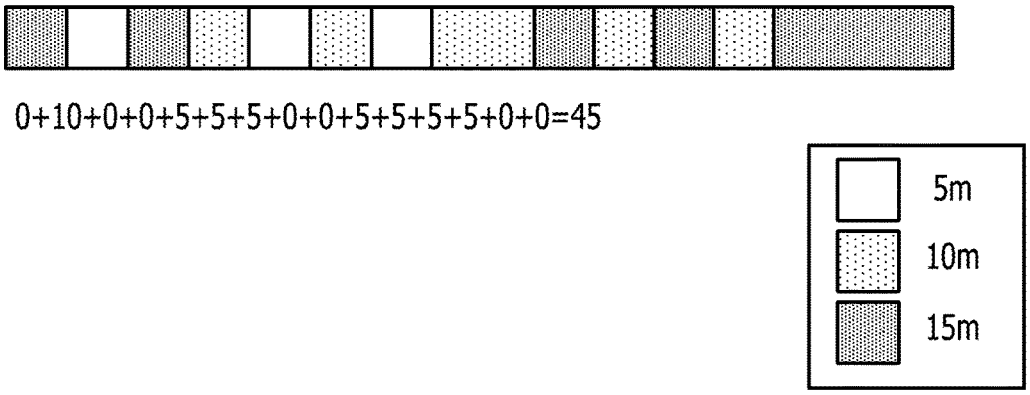
FIG. 22B is a diagram describing an evaluation value in the case where the shifting number M is −1 in the third operational example.
Figure 22C:
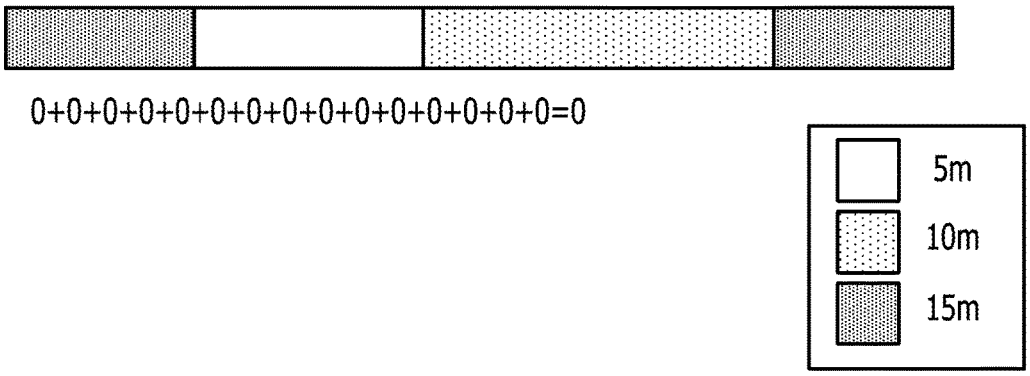
FIG. 22C is a diagram describing an evaluation value in the case where the shifting number M is 1 in the third operational example.

FIGS. 22A to 22C are diagrams describing effects of the third operational example. FIGS. 22A to 22C describes effects of correction information items obtained in the third operational example on the distance image illustrated in FIG. 10 and obtained using the normal assignment method when there are the deviations in the adjacency relationships between the sampling horizontal angles illustrated in FIG. 9 in the state illustrated in FIG. 7.

FIG. 22A is a diagram illustrating a distance image in the case where the shifting number M is 0. FIG. 22A schematically illustrates distance information items on a certain pixel row and a sum Sm for the certain pixel row. In the case where the shifting number M is 0, the shifting corresponds to the normal assignment method. Thus, the pixel row of the distance image illustrated in FIG. 22A corresponds to a single pixel row of the distance image illustrated in FIG. 10. In this case, as illustrated in FIG. 22A, the sum Sm=0+10+10+0+0+5+5+0+0+0+0+5+5+0+0=40.

FIG. 22B is a diagram illustrating a distance image in the case where the shifting number M is −1. FIG. 22B schematically illustrates distance information items on a certain pixel row and a sum Sm for the certain pixel row. In the case where the shifting number M is −1, the shifting corresponds to the correction assignment method (No. 1) illustrated in FIG. 13. In this case, as illustrated in FIG. 22B, the sum Sm=0+10+0+0+5+5+5+0+0+5+5+5+5+0+0=45.

FIG. 22C is a diagram illustrating a distance image in the case where the shifting number M is 1. FIG. 22C schematically illustrates distance information items on a certain pixel row and a sum Sm for the certain pixel row. In the case where the shifting number M is 1, the shifting corresponds to the correction assignment method (No. 2) illustrated in FIG. 13. In this case, as illustrated in FIG. 22C, the sum Sm=0+0+0+0+0+0+0+0+0+0+0+0+0+0+0=0. Although not illustrated, in the case where the shifting number M is 2 or −2, the sum Sm is not 0.

Thus, in the example illustrated in FIGS. 22 to 22C, since the smallest sum Sm is 0, the correction information item generator 152 generates a correction information item based on the sum Sm that is equal to 0. For example, since the sum Sm is 0 in the case where the shifting number M is 1, the correction information item generator 152 generates the correction information item indicating that the shifting number M is 1. In this case, the distance image illustrated in FIG. 18 is obtained by correcting the distance image (distance image generated using the normal assignment method) illustrated in FIG. 10 based on the shifting number M equal to 1. According to the third operational example, a deviation, caused in the normal assignment method, in an adjacency relationship between pixel value information items within a pixel row may be appropriately corrected, and a distance image that does not have a deviation in an adjacency relationship between pixel value information items may be obtained, like the aforementioned first operational example.

In the third operational example, the evaluation value calculator 151 calculates sums Sm based on Equation (3) as the evaluation values, but is not limited to this. For example, the evaluation value calculator 151 may calculate, as each of the evaluation values, the number of image portions in which the sign of the difference $\Delta D_N$ between an N-th pixel and an (N+1)-th pixel adjacent to the Nth pixel on the right side is different from the sign of the difference $\Delta D_{N+1}$ between the (N+1)-th pixel and an (N+2)-th pixel adjacent to the (N+1)-th pixel on the right side and in which absolute values of the differences are close to each other.

Fourth Operational Example

Figure 23:
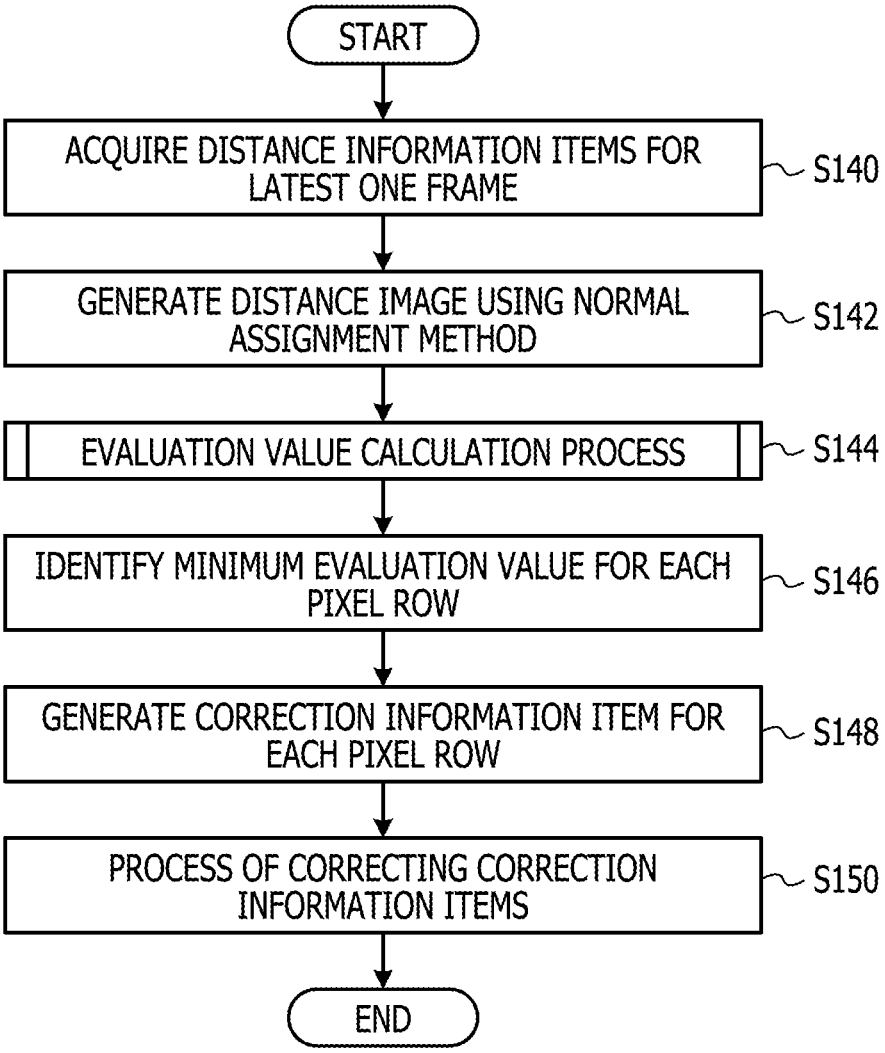
FIG. 23 is a flowchart of a process to be executed by the image information output apparatus in a fourth operational example.

FIG. 23 is a flowchart of a process to be executed by the image information output apparatus 100 in a fourth operational example.

Steps that are included in the process illustrated in FIG. 23 and are the same as those included in the process illustrated in FIG. 14 and related to the first operational example are indicated by the same step numbers as those illustrated in FIG. 14, and a description thereof is omitted. The process illustrated in FIG. 23 and the process illustrated in FIG. 14 are different from each other in that step S150 is set instead of step S149 in the process illustrated in FIG. 23. In the fourth operational example, an evaluation value calculation process is arbitrary, and the evaluation value calculation process described in the second operational example or the evaluation value calculation process described in the third operational example may be executed instead of the evaluation value calculation process described in the first operational example.

In step S150, the correction information item generator 152 executes a process of correcting the correction information items generated in step S148. The process of correcting the correction information items is described with reference to FIG. 24.

Figure 24:
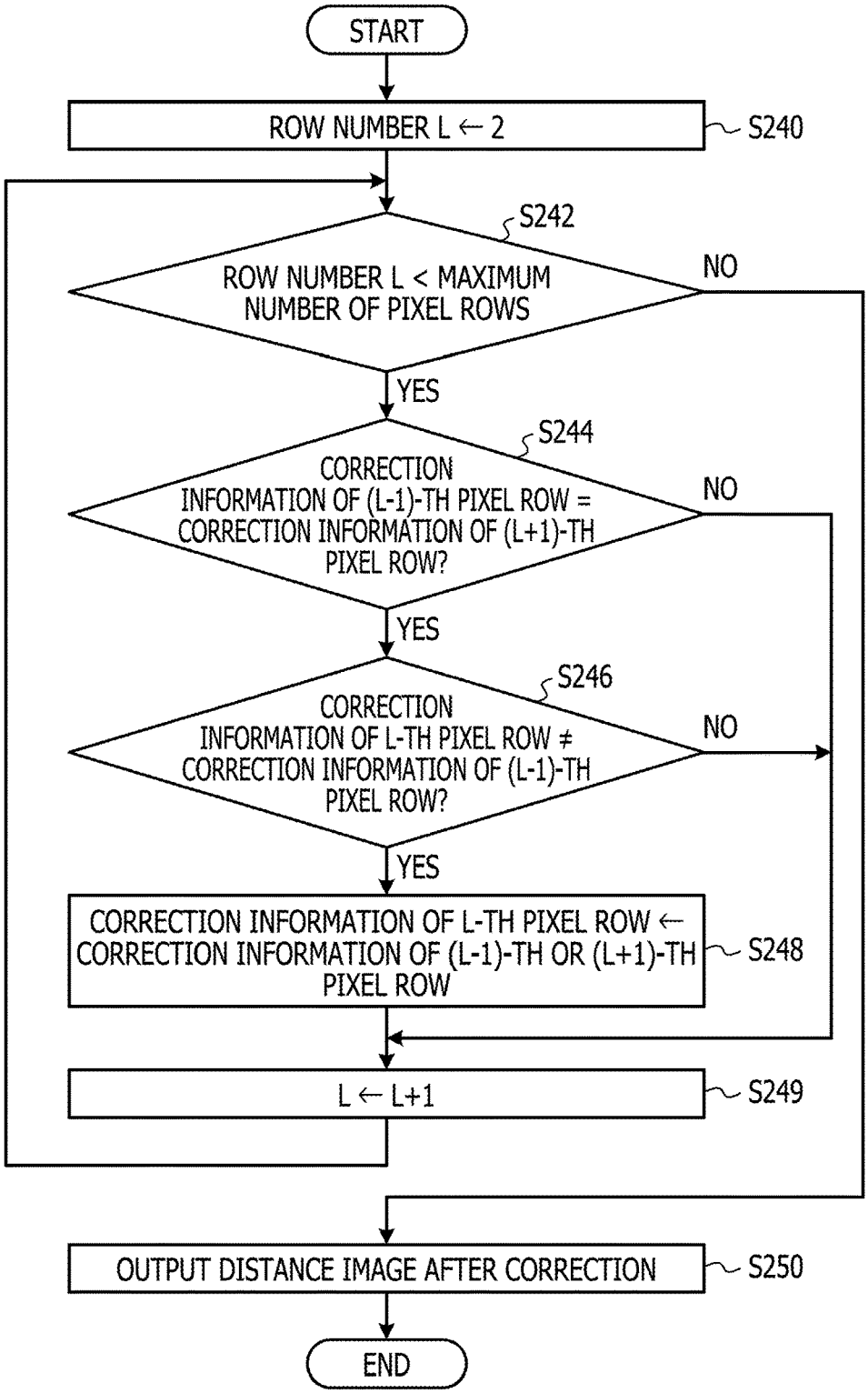
FIG. 24 is a flowchart of an example of a process of correcting correction information items in step S150.

FIG. 24 is a flowchart of an example of the process of correcting the correction information items in step S150.

In step S240, the correction information item generator 152 sets a row number L of a pixel row of the distance image to an initial value "2".

In step S242, the correction information item generator 152 determines whether or not the row number L is smaller than the maximum number of pixel rows. The maximum number of pixel rows corresponds to the number NNmax of all pixels arranged in the vertical direction in the distance image and is a defined value. If the row number L is smaller than the number NNmax of all pixels arranged in the vertical direction in the distance image, the process proceeds to step S244. If the row number L is not smaller than the number NNmax, the process proceeds to step S250.

In step S244, the correction information item generator 152 determines whether or not a correction information item (shifting number M causing the minimum evaluation value) of an (L−1)-th pixel row is the same as a correction information item (shifting number M causing the minimum evaluation value) of an (L+1)-th pixel row. If the result of the determination indicates "YES", the process proceeds to step S246. If the result of the determination indicates "NO", the process returns to step S242.

In step S246, the correction information item generator 152 determines whether or not a correction information item of the L-th pixel row is different from the correction information item of the (L−1)-th pixel row or the correction information item of the (L+1)-th pixel row. If the result of the determination indicates "YES", the process proceeds to step S248. If the result of the determination indicates "NO", the process proceeds to step S249 and returns to step S242.

In step S248, the correction information item generator 152 replaces the correction information item of the L-th pixel row with the correction information item of the (L−1)-th pixel row or the correction information item of the (L+1)-th pixel row. Specifically, the correction information item generator 152 corrects the correction information item of the L-th pixel row in such a manner that the correction information item of the L-th pixel row is the same as the correction information item of the (L−1)-th pixel row or the correction information item of the (L+1)-th pixel row.

In step S249, the correction information item generator 152 increments L by only "1".

In step S250, the correction information item generator 152 outputs a corrected distance image obtained by correcting the distance image generated in step S142 based on correction information items (including correction information items after the aforementioned correction), generated in step S148 or S248, of all the pixel rows for the one frame. Specifically, the correction information item generator 152 outputs the corrected distance image obtained by correcting the distance image generated in step S142 using the correction information item after the correction for the pixel row corrected in step S248 and using the correction information items generated in step S148 for pixel rows that are not corrected in step S248.

Figure 25:
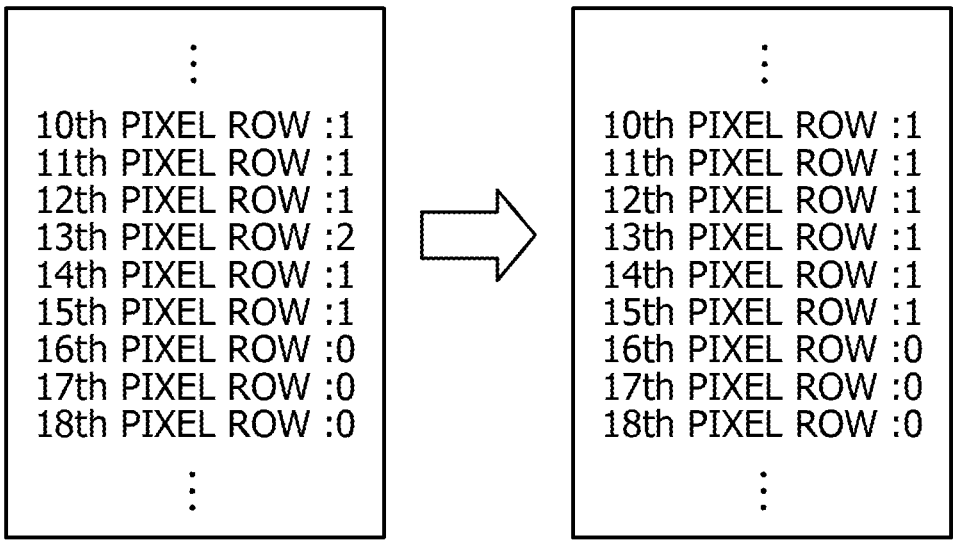
FIG. 25 is a diagram describing the process, illustrated in FIG. 24, of correcting the correction information items.

FIG. 25 is a diagram describing the process, illustrated in FIG. 24, of correcting the correction information items. FIG. 25 illustrates, on the left side, correction information items (correction information items generated in step S148) of pixel rows (only the 10th to 18th pixel rows are illustrated in FIG. 25) before the correction. In addition, FIG. 25 illustrates, on the right side, correction information items of the pixel rows (only the 10th to 18th pixel rows are illustrated in FIG. 25) after the correction executed in step S248. Numbers "0", "1", and "2" illustrated in FIG. 25 indicate values of the "shifting number M". In the example illustrated in FIG. 25, since correction information items of the 12th and 14th pixel rows indicate that the "shifting number M is 1", and a correction information item of the 13th pixel row indicates that the "shifting number M is 2", the correction information item of the 13th pixel row is replaced (corrected) with a correction information item indicating that the "shifting number M is 1".

Deviations in the adjacency relationships between the aforementioned sampling horizontal angles are not uniform in an entire distance image and tend to occur for each of pixel rows (for each of reciprocation scans). The deviations in the adjacency relationships between the sampling horizontal angles, however, are not completely independent of each other in the pixel rows. The distance image may have a characteristic in which deviations in adjacency relationships between sampling horizontal angles in multiple pixel rows adjacent to each other continuously occur and are the same as or similar to each other. If noise that is an isolated point or the like is included in a distance information item within the distance image during a certain reciprocation scan, a correction information item for the certain reciprocation scan may not be appropriate due to an effect of the noise.

According to the fourth operational example, attention is paid to the fact that deviations in adjacency relationships between sampling horizontal angles in multiple pixel rows adjacent to each other may continuously occur and may be the same as or similar to each other, and if a correction information item of a pixel row immediately preceding a certain pixel row is the same as a correction information item of a pixel row immediately succeeding the certain pixel row, and a correction information item of the certain pixel row is different from the correction information items of the pixel rows immediately preceding and succeeding the certain pixel row, the correction information item of the certain pixel row is replaced with the correction information item of the pixel row immediately preceding the certain pixel row or the correction information item of the pixel row immediately succeeding the certain pixel row. Thus, a probability at which the accuracy of correction information items is reduced due to an effect of noise may be reduced.

Although the embodiment is described above, the present disclosure is not limited to the specific embodiment. Various modifications and changes may be made without departing from the scope of claims. In addition, all the constituent elements described in the embodiment or two or more of the constituent elements described in the embodiment may be combined.

For example, in the aforementioned embodiment, the distance measuring apparatus 10 uses laser light as a measurement wave, but is not limited to this. For example, the distance measuring apparatus 10 may use another measurement wave such as a millimeter wave.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An apparatus for outputting image information, comprising:

a memory; and a processor coupled to the memory and configured to:

execute an acquisition process that includes acquiring pixel value information items from a sensor, the sensor being configured to execute a reciprocation scan with a measurement wave in a scan direction and output the pixel value information items obtained at multiple sampling angles during the reciprocation scan;

execute a calculation process that includes calculating, based on the pixel value information items for one reciprocating motion in the reciprocation scan for each of multiple different arrangement orders in which a chronological pixel value information item on a forward path and a reverse-chronological pixel value information item on a backward path are assumed to be alternately assigned, differences between the chronological pixel value information item and the reverse-chronological pixel value information item which are adjacent to each other in an arrangement direction; and execute a generation process that includes generating, based on the differences, a correction information item related to the pixel value information items for the one reciprocating motion in the reciprocation scan.

2. The apparatus according to claim 1, wherein the calculation process includes calculating, for each of the multiple arrangement orders, an evaluation value related to consistency between adjacency relationships between the multiple sampling angles in the scan direction and adjacency relationships between the pixel value information items in the arrangement direction, and wherein the generation process includes generating the correction information item based on results of comparing the evaluation values related to the multiple arrangement orders.

3. The apparatus according to claim 2, wherein the multiple arrangement orders include a first arrangement order that causes the adjacency relationships between the pixel value information items in the arrangement direction to be consistent with the adjacency relationships between the multiple sampling angles in the scan direction, and a second arrangement order that causes the pixel value information items on the backward path to be shifted toward one of both sides in the arrangement direction, compared with the first arrangement order.

4. The apparatus according to claim 3, wherein the multiple arrangement orders include multiple second arrangement orders, and wherein the multiple second arrangement orders cause the numbers of times that the pixel value information items on the backward path are shifted one by one toward one of both sides in the arrangement direction to be different from each other.

5. The apparatus according to claim 3, wherein the pairs are located within a central portion in the arrangement direction in each of the multiple arrangement orders.

6. The apparatus according to claim 2, wherein the calculation process includes calculating sums of absolute values of the differences as the evaluation values.

7. The apparatus according to claim 6, wherein the generation process includes generating, as the correction information item based on the smallest evaluation value among the evaluation values related to the multiple arrangement orders, information indicating an arrangement order related to the smallest evaluation value, or a single pixel row in which the pixel value information items for the one reciprocating motion in the reciprocation scan are arranged in the arrangement order related to the smallest value.

8. The apparatus according to claim 2, wherein the calculation process includes calculating the evaluation values based on a positive or negative sign of a value obtained by subtracting a pixel value information item, arranged on one of both sides in the arrangement direction, of each of the pairs from a pixel value information item, arranged on the other of both sides in the arrangement direction, of the pair.

9. The apparatus according to claim 8, wherein the calculation process includes calculating the evaluation values based on whether or not a first pair and a second pair that are among the pairs have a relationship in which the sign of a value obtained by subtracting one of pixel value information items of the first pair from the other of the pixel value information items of the first pair is different from the sign of a value obtained by subtracting one of pixel value information items of the second pair from the other of the pixel value information items of the second pair that is adjacent to the first pair and of which one of the pixel value information items is shared with the first pair.

10. The apparatus according to claim 9, wherein the calculation process includes calculating, as each of the evaluation values based on all pairs that are among the pairs and have the relationship, the sum of absolute values of either differences between pixel value information items of first pairs among the pairs or differences between pixel value information items of second pairs among the pairs.

11. The apparatus according to claim 8, wherein the calculation process includes calculating the evaluation values based on whether or not a first pair and a second pair that are among the pairs have a relationship in which the sign of a value obtained by subtracting one of pixel value information items of the first pair from the other of the pixel value information items of the first pair is different from the sign of a value obtained by subtracting one of pixel value information items of the second pair from the other of the pixel value information items of the second pair that is adjacent to the first pair and of which one of the pixel value information items is shared with the first pair and have a relationship in which the difference between the absolute value of the difference between the pixel value information items of the first pair and the absolute value of the difference between the pixel value information items of the second pairs is equal to or smaller than a predetermined value.

12. The apparatus according to claim 1, wherein the generation process includes generating a correction information item for each of reciprocation scans based on pixel value information items forming a single frame and related to the multiple reciprocation scans.

13. The apparatus according to claim 12, wherein the generation process includes correcting one or more correction information items among the multiple correction information items related to the multiple reciprocation scans based on another correction information item among the multiple correction information items.

14. The apparatus according to claim 13, wherein the correction information items indicate correction amounts related to the arrangement orders, wherein the generation process includes correcting, if two correction information items that are among the multiple correction information items related to the multiple reciprocation scans and are related to two reciprocation scans between which one reciprocation scan is executed indicate the same first correction amount, and a correction information item related to the one reciprocation scan executed between the two reciprocation scans indicates a correction amount different from the first correction amount, the correction information item related to the one reciprocation scan in such a manner that the correction information item related to the one reciprocation scan indicates the first correction amount.

15. The apparatus according to claim 12, wherein the sensor is a distance image sensor including a laser light source and an MEMS mirror, wherein the pixel value information items indicate distances, and wherein the generation process includes generating a distance image as the correction information items based on the pixel value information items forming the single frame and related to the multiple reciprocation scans.

16. The apparatus according to claim 1, wherein the sensor is configured in such a manner that the multiple regular sampling angles include multiple sampling angles related to the forward path and sampling angles that are related to the backward path and are between the multiple sampling angles related to the forward path.

17. The apparatus according to claim 1, wherein the multiple arrangement orders enable the pixel value information items to be associated with a single pixel row one by one in accordance with the arrangement direction.

18. A method performed by a computer for outputting image information, the method comprising:

executing, by a processor of the computer, an acquisition process that includes acquiring pixel value information items from a sensor, the sensor being configured to execute a reciprocation scan with a measurement wave in a scan direction and output the pixel value information items obtained at multiple sampling angles during the reciprocation scan;

executing, by the processor of the computer, a calculation process that includes calculating, based on the pixel value information items for one reciprocating motion in the reciprocation scan for each of multiple different arrangement orders in which a chronological pixel value information item on a forward path and a reverse-chronological pixel value information item on a backward path are assumed to be alternately assigned, differences between the chronological pixel value information item and the reverse-chronological pixel value information item which are adjacent to each other in an arrangement direction; and executing, by the processor of the computer, a generation process that includes generating, based on the differences, a correction information item related to the pixel value information items for the one reciprocating motion in the single reciprocation scan.

19. A non-transitory computer-readable storage medium for storing a program that causes a processor to execute a process for outputting image information, the process comprising:

executing an acquisition process that includes acquiring pixel value information items from a sensor, the sensor being configured to execute a reciprocation scan with a measurement wave in a scan direction and output the pixel value information items obtained at multiple sampling angles during the reciprocation scan;

executing a calculation process that includes calculating, based on the pixel value information items for one reciprocating motion in the reciprocation scan for each of multiple different arrangement orders in which a chronological pixel value information item on a forward path and a reverse-chronological pixel value information item on a backward path are assumed to be alternately assigned, differences between the chronological pixel value information item and the reverse-chronological pixel value information item which are adjacent to each other in an arrangement direction; and executing a generation process that includes generating, based on the differences, a correction information item related to the pixel value information items for the one reciprocating motion in the reciprocation scan.

* * * * *